US010024265B2

(12) United States Patent
Martin et al.

(10) Patent No.: US 10,024,265 B2
(45) Date of Patent: Jul. 17, 2018

(54) SYSTEMS AND METHODS FOR ESTIMATING EXHAUST PRESSURE

(71) Applicant: Ford Global Technologies, LLC, Dearborn, MI (US)

(72) Inventors: Douglas Raymond Martin, Canton, MI (US); John Eric Rollinger, Troy, MI (US); Richard E. Soltis, Saline, MI (US); Jennifer Helen Chang, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 48 days.

(21) Appl. No.: 15/209,625

(22) Filed: Jul. 13, 2016

(65) Prior Publication Data

US 2018/0017008 A1 Jan. 18, 2018

(51) Int. Cl.

| | |
|---|---|
| ***F02D 41/30*** | (2006.01) |
| ***F02D 41/26*** | (2006.01) |
| ***F02D 41/14*** | (2006.01) |

(52) U.S. Cl.

CPC ..... *F02D 41/3005* (2013.01); *F02D 41/1454* (2013.01); *F02D 41/26* (2013.01)

(58) Field of Classification Search

CPC ... F02D 41/3005; F02D 41/1454; F02D 41/26
See application file for complete search history.

(56) References Cited

U.S. PATENT DOCUMENTS

| | | | | |
|---|---|---|---|---|
| 5,598,703 | A | 2/1997 | Hamburg et al. | |
| 7,426,926 | B2 | 9/2008 | Husak et al. | |
| 8,683,786 | B2 | 4/2014 | Ruona et al. | |
| 2007/0234712 | A1 * | 10/2007 | Ohmura | F01N 9/002 60/297 |
| 2012/0104745 | A1 * | 5/2012 | Story | F02B 37/02 285/133.11 |

FOREIGN PATENT DOCUMENTS

| | | | |
|---|---|---|---|
| EP | 0731266 | A1 | 9/1996 |
| EP | 2708726 | A1 | 3/2014 |
| JP | 2006161626 | A * | 6/2006 |

OTHER PUBLICATIONS

Makled, Daniel A., et al., "Methods and Systems for Estimating Exhaust Pressure with a Variable Voltage Oxygen Sensor," U.S. Appl. No. 14/637,060, filed Mar. 3, 2015, 57 pages.

* cited by examiner

*Primary Examiner* — Hung Q Nguyen
*Assistant Examiner* — Xiao Mo
(74) *Attorney, Agent, or Firm* — Julia Voutyras; McCoy Russell LLP

(57) ABSTRACT

Methods and systems are provided for estimating exhaust pressure based on an exhaust air/fuel ratio sensor. In one example, a method may comprise estimating an exhaust pressure based on periodic waveform outputs of an exhaust air/fuel ratio (AFR) sensor, and adjusting at least one engine operating parameter based on the estimated exhaust pressure. The exhaust pressure may be estimated based on one or more of the standard deviation and frequency of the periodic waveform outputs.

20 Claims, 8 Drawing Sheets

SYSTEMS AND METHODS FOR ESTIMATING EXHAUST PRESSURE

FIELD

The present description relates generally to methods and systems for estimating exhaust pressure in an internal combustion engine.

BACKGROUND/SUMMARY

Measurements and/or estimates of exhaust pressure of an exhaust flow flowing through an exhaust passage of an internal combustion engine may be used as inputs in various vehicle control strategies in order to control engine operation. In one example, engines may include a dedicated, standalone pressure sensor positioned in an exhaust passage of the engine, upstream of a catalyst, to measure exhaust pressure. As such, accurate exhaust pressure measurements may be important for controlling operation of various vehicle control strategies.

Additionally, excessive exhaust pressures in an engine may result in increased pumping losses and fuel consumption. Flow restrictions in the exhaust, such as particulate filters, may exacerbate exhaust pressure spikes. For example, a particulate filter restricts exhaust gas flow and increases exhaust pressure as it becomes more loaded with soot. Particulate filters may be regenerated periodically to purge accumulated particulate matter. However, such regeneration events may come with at the expense of fuel consumption. As a result, accurate exhaust pressure estimates are needed to determine the loading state of the particulate filter and schedule regeneration of the particulate filter at optimal times that minimize fuel consumption. Further, accurate estimates of the exhaust pressure are important to prevent and/or minimize exhaust pressure spikes.

However, some engines may not include an exhaust pressure sensor. Dedicated exhaust pressure sensors may increase engine system costs and engine system control complexity. In such examples, the exhaust pressure may be modeled based on alternate engine operating conditions such as intake mass airflow, and/or sensor measurements.

However, the inventors herein have recognized that these exhaust pressure models may have errors that may cascade into additional models that use the modeled exhaust pressure. For example, approaches aimed at measuring exhaust pressure based on intake mass airflow may have reduced accuracy as they do not account for the effects of exhaust restrictions such as particulate filters of the exhaust pressure. Additionally, certain models may be bounded by a window in which exhaust pressure may only be modeled under certain engine operating conditions. As a result, engine control based on exhaust pressure estimates during operation outside of the window may have reduced accuracy.

In one example, the issues described above may be addressed by a method for monitoring periodic waveform outputs from an exhaust air/fuel ratio (AFR) sensor during closed loop fuel control, estimating an exhaust pressure based on one or more of a standard deviation and average frequency of cycles of the periodic waveform outputs, and adjusting at least one engine operating parameter based on the estimated exhaust pressure. In this way, an existing engine sensor (e.g., an exhaust AFR sensor) may be used to more accurately estimate engine exhaust pressure, thereby increasing an accuracy of engine control based on exhaust pressure estimates.

As one example, the AFR sensor may comprise an exhaust gas oxygen sensor and may be configured to measure a partial pressure of oxygen in exhaust gas. A controller may adjust an amount of fuel injected into one or more engine cylinders based on the outputs received from the AFR sensor. Thus, fuel injection may be feedback controlled based on the AFR sensor. However, since the oxygen sensor measures the partial pressure of oxygen in the sampled exhaust gas, the amount of oxygen measured by the sensor increases for increases in the exhaust pressure and therefore exhaust gas density. As such, fluctuations in the outputs of the AFR sensor may be used to infer changes in the exhaust gas pressure. In particular, the AFR sensor output may comprise a periodic waveform signal resulting from continuous oscillation between leaner than stoichiometry and richer than stoichiometry fuel injection commands. One or more of the frequency, amplitude and/or standard deviation of the periodic waveform signal of the AFR sensor may fluctuate in proportion to changes in the exhaust pressure. Thus, changes in the characteristics of the waveform output of the AFR sensor may be indicative of exhaust pressure changes. A controller may then adjust engine operation based on the determined change in exhaust pressure.

In another representation, a method comprises monitoring periodic waveform outputs of a fuel controller during closed loop fuel control, estimating an exhaust pressure based on the waveform outputs of the controller, and adjusting at least one engine operating parameter based on the estimated exhaust pressure.

In yet a further representation, an engine system comprises an exhaust oxygen sensor, one or more fuel injectors, and a controller with computer readable instructions stored in non-transitory memory for: determining a commanded amount of fuel to be injected by the one or more fuel injectors based on outputs from the exhaust oxygen sensor, adjusting the one or more fuel injectors to inject the commanded amount of fuel, and estimating an exhaust pressure based on one or more of the outputs from the exhaust oxygen sensor and changes in the commanded amount of fuel over a duration.

In this way, more accurate estimates of the exhaust pressure may be obtained that account for flow restrictions in the exhaust. As a result, engine control based on exhaust pressure estimates may be improved. Further, the cost of the engine system may be reduced by using utilizing an existing engine sensor to estimate exhaust pressure instead of a dedicated pressure sensor.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
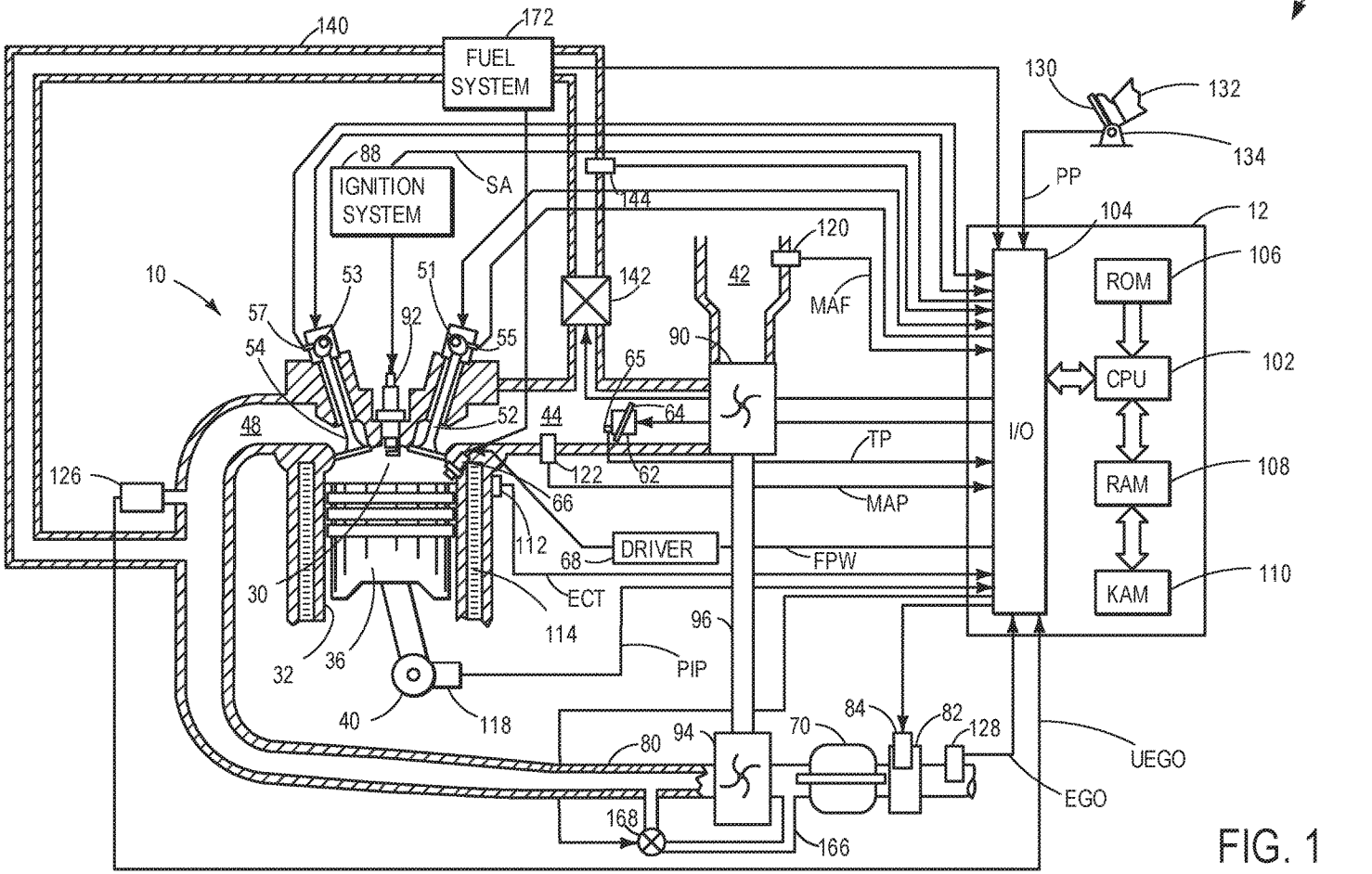
FIG. 1 shows a schematic diagram of an example engine system including an exhaust air/fuel ratio sensor, in accordance with an embodiment of the present disclosure.

The following description relates to systems and methods for estimating exhaust pressure in an internal combustion engine, such as the example engine system shown in FIG. 1. In particular, the exhaust pressure may be estimated based on outputs from an exhaust air/fuel ratio sensor, such as an exhaust oxygen sensor. Outputs from the exhaust air/fuel ratio sensor may be used to determine how much fuel to inject into the combustion engine (in combination with a desired air/fuel ratio, for example). For example, a fuel controller of a fuel control system, such as the fuel control system shown in FIG. 2, may adjust an amount of fuel injected into the engine based on the outputs from the exhaust air/fuel ratio sensor to maintain a desired air/fuel ratio. Additionally, outputs from the air/fuel ratio sensor may be used to estimate changes in exhaust pressure, as described in the example routine of FIG. 3. For example, FIGS. 4A-4D provide example plots depicting how outputs from the air/fuel ratio sensor may change under time-varying exhaust pressures. In response to changes in the exhaust pressure determined from the outputs of the air/fuel ratio sensor, an engine controller, such as the fuel controller, may adjust one or more engine actuators.

Referring now to FIG. 1, a schematic diagram 100 showing one cylinder of multi-cylinder engine 10, which may be included in a propulsion system of an automobile, is illustrated. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. The proportional pedal position signal represents a driver demanded torque which is an amount of torque requested by the vehicle operator 132. Thus, the operator 132 may request more or less torque by adjusting a position of the input device 130. In one example, the operator 132 may request for more torque by depressing the input device 130, and may request for less torque by releasing the input device 130.

Combustion chamber (i.e., cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases to exhaust manifold 48 en route to exhaust passage 80. Intake manifold 44 and exhaust manifold 48 can selectively communicate with combustion chamber 30 via respective intake valve 52 and exhaust valve 54. In some embodiments, combustion chamber 30 may include two or more intake valves and/or two or more exhaust valves.

In the example of FIG. 1, intake valve 52 and exhaust valve 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT), and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

In some embodiments, each cylinder of engine 10 may be configured with one or more fuel injectors for providing fuel thereto. As a non-limiting example, cylinder 30 is shown including one fuel injector 66, which is supplied fuel from fuel system 172. Fuel injector 66 is shown coupled directly to cylinder 30 for injecting fuel directly therein in proportion to the pulse width of signal FPW received from controller 12 via electronic driver 68. In this manner, fuel injector 66 provides what is known as direct injection (hereafter also referred to as "DI") of fuel into combustion cylinder 30.

It will be appreciated that in an alternate embodiment, injector 66 may be a port injector providing fuel into the intake port upstream of cylinder 30. It will also be appreciated that cylinder 30 may receive fuel from a plurality of injectors, such as a plurality of port injectors, a plurality of direct injectors, or a combination thereof.

Continuing with FIG. 1, intake passage 42 may include a throttle 62 having a throttle plate 64. In this particular example, the position of throttle plate 64 may be varied by controller 12 via a signal provided to an electric motor or actuator included within throttle 62, a configuration that is commonly referred to as electronic throttle control (ETC). For example, the controller 12 may include a look-up table that relates positions of the input device 130 to desired throttle positions. Thus, based on the position of the input device 130, the controller 12 may command the actuator of the throttle 62 to adjust the throttle plate 64 to the desired position. In this manner, throttle 62 may be operated to vary an amount of intake air provided to combustion chamber 30 among other engine cylinders. Thus, the throttle plate 64 may be adjusted to adjust an amount of air provided to the engine 10 based on a position of the input device 130. In particular, the throttle plate 64 may be adjusted to a more open position in proportion to an amount of depression of the input device 130. Thus as the operator 130 depresses the accelerator pedal of the input device 130, the throttle plate 64 may be adjusted to a more open position to increase an amount of air flowing to the engine cylinder 30. In the description herein of throttle plate 64 and any other valves or adjustable apertures, adjusting the valve to a more open position comprises increasing an opening formed by the valve, thus allowing for greater fluid mass flow rates through the valve.

Further, in the description of valves herein, the valves may be one or more of binary valves (e.g., two-way valves) or continuously variable valves. Binary valves may be adjusted to either fully open or fully closed (shut) position. A fully open position is a position in which the valve exerts substantially no flow restriction, and a fully closed position of a valve is a position in which the valve restricts all flow such that no flow may pass through the valve. In contrast, continuously variable valves may be partially opened to varying degrees. Thus, continuously variable valves may be opened to the open and closed positions, and additionally to one or more positions between the open and closed positions. Thus, the cross-sectional flow area of continuously variable valves may be adjusted to varying sizes by adjusting the valve between the open and closed positions, where the opening or cross-sectional flow area formed by the valve increases with increasing deflection towards the open position and away from the closed position.

However, it should be appreciated that in some examples, the controller 12 may adjust the position of the throttle 62 based on both the position of input device 130 and on additional engine operating conditions. For example, the controller 12 may adjust the throttle plate 64 to a more open position for increases in auxiliary loads, such as increases in demand for air conditioning and thus electrical power supplied to an A/C compressor. As another example, the controller 12 may adjust the throttle plate 64 based on an amount of boost provided by a turbocharger or supercharger of the engine 10. In yet another example, the controller 12 may adjust the throttle plate 64 based on exhaust pressure. For example, the controller 12 may send signals to the actuator of the throttle 62 to adjust the throttle plate 64 to a more closed position in response to exhaust pressures increasing above a threshold. The throttle plate 64 may be adjusted to a more closed position than would normally be commanded during ETC by the controller 12 when only considering input from the operator 130 via input device 132. Closing the throttle 62 may decrease exhaust pressure.

Further, the controller 12 may adjust the amount of fuel injected to the cylinder 30 by injector 66 based on the position of throttle plate 64 and an amount of air flowing to the engine cylinder 30, to achieve a desired air-fuel ratio. For example, the desired air-fuel ratio may in some examples be stoichiometric (e.g., 14.7:1 air-fuel ratio).

The position of throttle plate 64 may be provided to controller 12 by throttle position signal TP provided by a throttle position sensor 65 which may be physically coupled to the throttle 62 for measuring a position of the throttle plate 64. Intake passage 42 may include a mass air flow sensor 120 for providing a measurement of an amount of air flowing to the cylinder 30. In some examples, the mass air flow sensor 120 may be positioned in the intake passage 42, as shown in the example of FIG. 1. However, in other examples, the mass air flow sensor 120 may be positioned in the intake manifold 44. A manifold air pressure sensor 122 may be positioned in the intake manifold 44 for providing an indication of the manifold air pressure (MAP).

In some examples, the engine system 10 may include a turbocharger and/or supercharger. In the example of FIG. 1, the engine system 10 is shown to include a turbocharger. The turbocharger comprises a compressor 90 positioned in the intake passage 42, coupled to a turbine 94, positioned in the exhaust passage 80. Exhaust gasses flowing through the exhaust passage 80 may spin the turbine 94 which may be coupled to the compressor 90 via a shaft 96 or other mechanical linkage. As the turbine 94 spins, it causes the compressor 90 to spin, and the spinning compressor 90 compresses intake air provided to the throttle 62. Thus, the compressor 90 may pressurize the air received from intake passage 42 to a higher pressure than barometric pressure (BP). The amount of pressure added to the intake air may be referred to herein as boost pressure. An amount of boost provided by the compressor 90 may be adjusted via a wastegate valve 168 positioned in a bypass passage 166 of the turbine 94.

The bypass passage 166 may be coupled at opposite ends to the exhaust passage 80 and around the turbine 94, providing a route for exhaust gasses to travel around the turbine 94. The wastegate valve 168 may be positioned in the bypass passage 166 for regulating an amount of gasses flowing through the bypass passage 166, and therefore through the turbine 94. The wastegate valve 168 may be adjusted to a more open position to increase the amount of gasses flowing through the bypass passage 166 and decrease the amount of gasses flowing through the turbine 94. Conversely, the wastegate valve 168 may be adjusted to a more closed position to increase the amount of gasses flowing through the turbine 94 and decrease the amount of gasses flowing through the bypass passage 166. As such, opening the wastegate valve 168 may reduce a speed of the turbine 94 and thus reduce an amount of boost provided by the compressor 90. Conversely, closing the wastegate valve 168 may increase the speed of the turbine 94 and may increase the amount of boost provided by the compressor 90. Controller 12 may be electrically coupled to an actuator of the wastegate valve 168. Thus, the position of the wastegate valve 168 may be adjusted by the actuator based on signals received from the controller 12.

In one example, the controller 12 may adjust the wastegate valve 168 to a more open position to decrease exhaust pressure in exhaust passage 80. In particular, in response to exhaust pressure increasing above a threshold the controller 12 may adjust the wastegate valve 168 to a more open position to reduce exhaust pressure.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark. In yet further examples, engine 10 may be configured as a diesel engine and may not include a spark plug 92.

An upstream first air/fuel ratio (AFR) sensor 126 is shown coupled to exhaust passage 80 upstream of emission control device 70. Upstream first AFR sensor 126 may be any suitable sensor for providing an indication of exhaust gas air-fuel ratio such as an oxygen sensor. For example, the AFR sensor 126 may be an oxygen sensor such as a linear wideband oxygen sensor or UEGO (universal or wide-range exhaust gas oxygen). As such, upstream first AFR sensor 126 may also be referred to herein as upstream first oxygen sensor 126. In other examples, the AFR sensor 126 may be one or more of a two-state narrowband oxygen sensor or EGO, a HEGO (heated EGO), a NOx, HC, or CO sensor. In embodiments where the AFR sensor 126 is an oxygen sensor, such as a UEGO sensor, the AFR sensor 126 is configured to provide output, such as a voltage signal, that is proportional to the amount of oxygen present in the exhaust. Controller 12 uses the output to determine the exhaust gas air-fuel ratio.

In particular, the partial pressure of oxygen in exhaust gas sampled by the AFR sensor 126 may be inversely proportional to a voltage generated by the sensor 126 and transmitted to the controller 12. That is, the voltage output by the sensor 126 may monotonically decrease for increases in the amount of oxygen in the exhaust gas. Thus, the voltage output by the sensor 126 may be higher for air-fuel ratios richer than stoichiometry (e.g., 14.7:1 air-fuel ratio), and may be lower for air-fuel ratios leaner than stoichiometry.

Emission control device 70 is shown arranged along exhaust passage 80 downstream of AFR sensor 126. Device 70 may be a three way catalyst (TWC), configured to reduce NOx and oxidize CO and unburnt hydrocarbons. In some embodiments, device 70 may be a NOx trap, various other emission control devices, or combinations thereof.

A particulate filter 82 may be included downstream of the emissions control device 70 and/or may be included within the emissions control device 70. The particulate filter 82 may trap particulates such as soot. The particulate filter 82 may be one or more of a diesel particulate filter (DPF) and/or a gasoline particulate filter (GPF). As soot accumulates on the filter 82, exhaust pressure may increase. Thus, the filter 82 may include a heater 84 for periodically regenerating the filter 82. The heater 84 may be electrically coupled to the controller 12, and may be powered on based on signals received from the controller 12. For examples, in response to exhaust pressures increasing above a threshold, the controller 12 may send signals to the heater 84 to power on and burn the particulate matter trapped within the filter 82. Thus, the heater 84 may be powered on to burn particulate matter accumulated on the filter 82, to regenerate the filter 82. In some examples, the filter 82 may be regenerated at regular intervals such as after a threshold duration, number of engine cycles, etc., and/or based on engine operating conditions such as exhaust pressure.

A second, downstream AFR sensor 128 is shown coupled to exhaust passage 80 downstream of emissions control device 70. Downstream sensor 128 may be any suitable sensor for providing an indication of exhaust gas air-fuel ratio such as a UEGO, EGO, HEGO, etc. In one embodiment, downstream sensor 128 is an EGO configured to indicate the relative enrichment or enleanment of the exhaust gas after passing through the emissions control device 70. As such, the EGO may provide output in the form of a switch point, or the voltage signal at the point at which the exhaust gas switches from lean to rich.

Further, in the disclosed embodiments, an exhaust gas recirculation (EGR) system may route a desired portion of exhaust gas from exhaust passage 80 to intake passage 42 and/or intake manifold 44 via EGR passage 140. The amount of EGR provided to intake passage 42 may be varied by controller 12 via EGR valve 142. Further, an EGR sensor 144 may be arranged within the EGR passage and may provide an indication of one or more of pressure, temperature, and concentration of the exhaust gas. Under some conditions, the EGR system may be used to regulate the temperature of the air and fuel mixture within the combustion chamber.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP.

Storage medium read-only memory 106 can be programmed with computer readable data representing non-transitory instructions executable by processor 102 for performing the methods described below as well as other variants that are anticipated but not specifically listed. The controller 12 receives signals from the various sensors of FIG. 1 and employs the various actuators of FIG. 1 to adjust engine operation based on the received signals and instructions stored on a memory of the controller 12. Thus, the controller may estimate exhaust pressure in the exhaust passage 80 based on signals received from one or more of the AFR sensors 126 and/or 128. Based on the exhaust pressure and/or other engine operating parameters, such as driver demanded torque, boost, engine speed, etc., the controller 12 may adjust one or more of the wastegate valve 168, intake throttle 62, and heater 84 of the particulate filter 82.

As described above, FIG. 1 shows only one cylinder of a multi-cylinder engine, and each cylinder may similarly include its own set of intake/exhaust valves, fuel injector, spark plug, etc.

Figure 2:
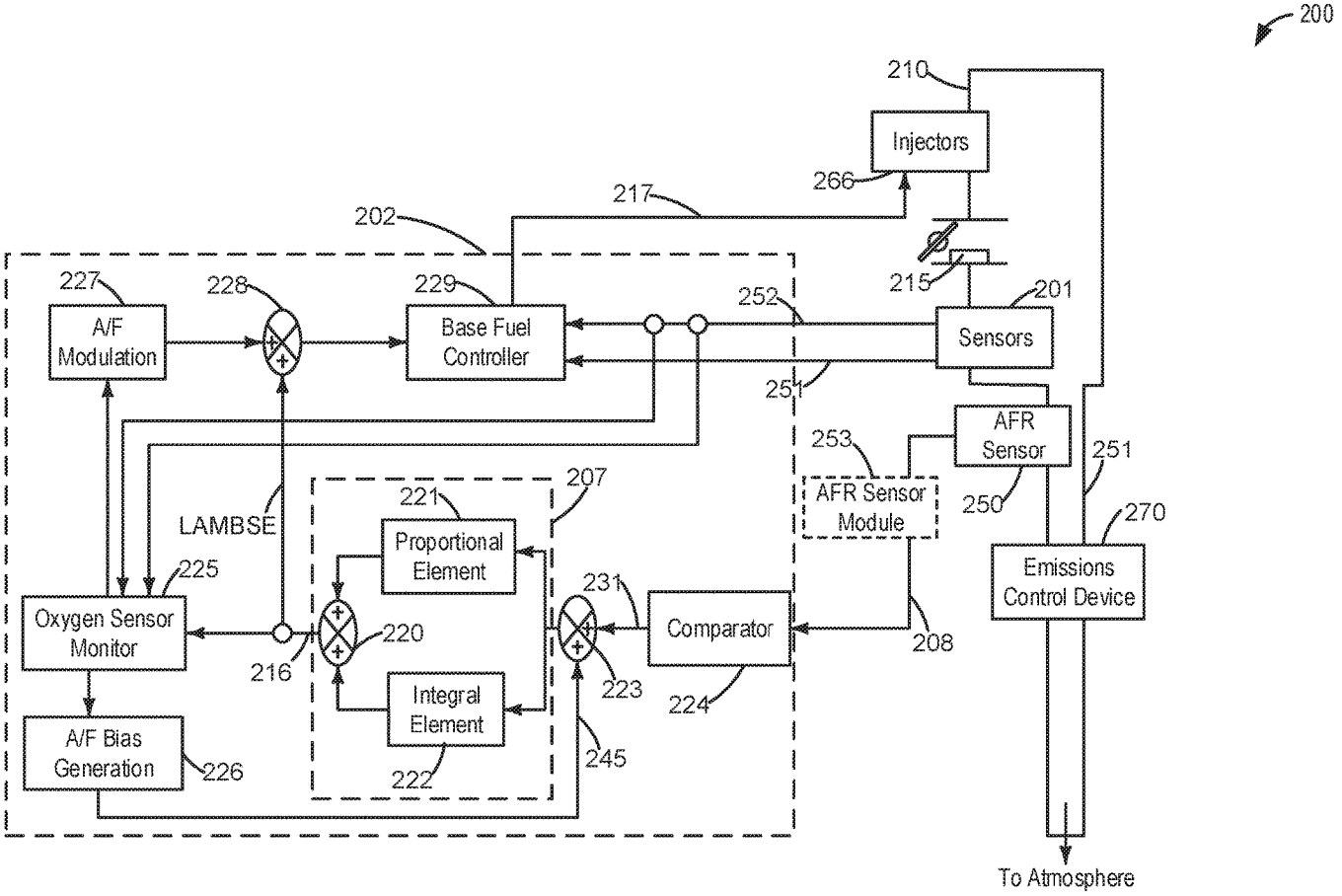
FIG. 2 shows a schematic diagram of an example fuel control system for regulating fuel injection in an internal combustion engine based on outputs from an exhaust air/fuel ratio sensor, such as the example engine system and air/fuel ratio sensor shown in FIG. 1, in accordance with an embodiment of the present disclosure.

Continuing to FIG. 2, it shows a schematic providing a more detailed depiction of an engine controller which may be used to control the air/fuel ratio of an engine. In particular, FIG. 2, shows a schematic depiction of a fuel control system 200, including controller 202, which may be the same or similar to controller 12 described above with reference to FIG. 1, that sends electrical signals to one or more fuel injectors 266 for adjusting the amount of fuel injected to one or more cylinders of an engine 210. Injectors 266 may be the same or similar to fuel injector 66 described above with reference to FIG. 1, and engine 210 may be the same or similar to engine 10 described above with reference to FIG. 1.

Controller 200 may adjust the amount of fuel injected by the injectors 266 based on a desired air fuel ratio, such as stoichiometry (14.7:1), and on outputs received from an exhaust AFR 250. AFR sensor 250 may also be referred to herein as exhaust oxygen sensor 250. AFR sensor 250 may be the same or similar to AFR sensor 126 described above with reference to FIG. 1. Thus, the AFR sensor 250 may be one or more of a HEGO, EGO, UEGO, or other type of oxygen sensor that measures an amount (e.g., mass, moles, etc.) of oxygen in exhaust gasses in exhaust passage 251. That is, outputs from the AFR sensor 250 may correspond to an amount of oxygen included in the exhaust gasses. AFR sensor 250 may send an output voltage signal 208, corresponding to the amount of oxygen in the exhaust gasses, to the controller 202. Thus, the AFR sensor 250 may be electrically coupled to the controller 200.

Thus, outputs from AFR sensor 250 may change depending on the concentration of oxygen in the exhaust gasses and/or on the density of the exhaust gasses. In particular, the amount of oxygen measured by the AFR sensor 250 may increase for increases in the concentration of oxygen in the exhaust gasses and/or increases in the density of the exhaust gasses. Thus, even when the concentration of oxygen in the exhaust gasses remains substantially the same and non-zero, an increase in the density of the exhaust gasses may cause a corresponding increase in the amount of oxygen measured by the AFR sensor 250. This is due to the fact that as the exhaust gasses increase in density, the absolute amount (e.g., mass) of the gasses, including oxygen, per volume of sampled exhaust gasses increases.

In particular, a voltage output signal 208 generated by the AFR sensor 250 may increase for decreases in the amount of oxygen contained in the exhaust gasses. Similarly, the voltage output by the AFR sensor 250 may decrease for increases in the amount of oxygen contained in the exhaust gasses as described in greater detail below with reference to FIGS. 4A-4D. The amount of oxygen contained in the exhaust gasses may increase for increases in the pressure of the exhaust gasses. That is, the voltage output by the AFR sensor 250 may decrease for increases in the exhaust pressure at a given air/fuel ratio and/or oxygen concentration as described in greater detail below with reference to FIGS. 4A-4D.

However, it should be appreciated that the amount of oxygen measured by the AFR sensor may not change in response to changes in density of the exhaust gasses when there is substantially no (e.g., zero) oxygen in the exhaust gasses. That is, when the exhaust gasses contain no oxygen, changes in the density of the exhaust gasses may have no effect on the amount of oxygen measured by the AFR sensor 250, as the amount of oxygen remains the same (zero), when the exhaust gasses contain no oxygen.

A catalytic converter 270, which may be the same or similar to emissions control device 70 described above with reference to FIG. 1, operates to purify exhaust gasses prior to emissions to the atmosphere as described above in greater detail with reference to FIG. 1. Still other sensors, indicated generally at 201, provide additional information about engine operation to the controller 202, such as crankshaft position, crankshaft angular velocity, throttle position, etc. The information from these sensors is used by the controller 202 to control engine operation.

A mass air flow detector 215 positioned at the air intake of engine 210 detects the amount of air being supplied to cylinders for combustion. The controller 202 is shown in electrical communication with the AFR sensor 250 and injectors 266 for adjusting fuel injection amounts based on outputs from the AFR sensor 250. The controller 202 may include one or more microcontrollers, each being comprised of one or more integrated circuits providing a processor, a read-only memory (ROM) which stores configuration data and the programs executed by the processor, peripheral data handling circuits, and a random access read/write scratchpad memory for storing dynamically changing data. These microcontrollers typically include built-in analog-to-digital conversion capabilities useful for translating analog signals from sensors and the like into digitally expressed values, as well as timer/counters for generating timed interrupts.

A microcontroller 207 may be further included within the controller 202 to implement proportional plus integral (P-I) closed loop feedback control of fuel injection to maintain the air/fuel ratio to a desired air/fuel ratio such as stoichiometry. The microcontroller 207 may comprise a proportional element 121, an integral element 122, and an adder 120 to sum the outputs of the proportional and integral elements.

AFR sensor 250 generates voltage outputs that may be communicated to the comparator 224. The voltage outputs of the AFR sensor 250 may be the raw, unfiltered outputs from the sensor 250. In some examples, an AFR sensor module 253 may be included in the fuel control system 200 and may be electrically coupled to the AFR sensor 250 for modifying outputs of the sensor 250. In particular, the AFR sensor module 253 may include instructions stored in non-transitory memory for adjusting the outputs from the AFR sensor 250 to compensate for changes in exhaust pressure. As explained above, changes in the exhaust pressure may affect the output of the AFR sensor 250 even when the oxygen concentration in the exhaust gas remains the same. The AFR sensor module 253 may adjust the signal communicated to the comparator 224 to compensate for such pressure changes in the exhaust. As one example, the AFR sensor module 253 may adjust the voltage output by the AFR sensor to a higher voltage, representing a lower oxygen amount, in response to an increase in exhaust pressure.

However, in other examples, the AFR sensor module 253 may not be included in the fuel control system 200 and the raw voltage outputs of the AFR sensor 250 may be communicated directly to the comparator without alteration or adjustment. The signal provided to the comparator 224 from the AFR sensor 250 may be referred to as the LAMBDA signal 208. In examples, where the AFR sensor module 253 is included in the fuel control system 200, the LAMBDA signal may be generated by the module 253 and may include the adjusted AFR sensor output that has been pressure compensated. However, in examples where the AFR sensor module 253 is not included in the fuel control system 200, the LAMBDA signal may be the raw voltage output of the AFR sensor and may not be pressure compensated.

The comparator 124 receives the LAMBDA signal 208 and generates a deviation signal 231 representing the deviation or difference between the air/fuel ratio measured via the LAMBDA signal and the desired air/fuel ratio. The controller 202 may modify the signal 231 at adder 223 based on an air/fuel bias signal 245 generated by air/fuel bias generation function 226. Based on the deviation, the microcontroller 207 then generates proportional and integral terms at the proportional element 221 and integral element 222, respectively. Together, the proportional and integral elements are used to generate a commanded fuel injection signal 216 called LAMBSE. In some examples, LAMBSE is the commanded amount of fuel to be injected by the injectors. Thus, LAMBSE may be directly communicated to the fuel injectors 266. However, in other examples, LAMBSE is a change in the fuel injection amount from a current fuel injection amount. In such examples, such as the example shown in FIG. 2, LAMBSE 216 may be communicated to a summer 228, which may adjust LAMBSE 216 based on an oxygen sensor monitor function 225. The modified LAMBSE signal may be communicated to a further control module 229 which calculates a fuel delivery value, and supplies the resulting fuel delivery value signal 217 to the injectors 266. Example plots of the LAMBSE signal 216 and LAMBDA signal 208 are shown below with reference to FIGS. 4A-4D.

In some examples, the controller 202 may further implement an air/fuel modulator function, seen at 227, an oxygen sensor monitoring function seen at 225, and an (A/F) bias generation function seen at 226.

In examples, where the AFR sensor module 253 is included in the fuel control system 202, the LAMBDA signal 208 may be substantially unaffected by varying exhaust pressures. As such, the LAMBSE signal generated based on the LAMBDA signal may remain substantially the same for constant oxygen concentrations under varying exhaust pressures. However, the controller 202 may still receive direct raw output from the AFR sensor 250 even when the module 253 is included. Thus, the controller 202 may receive periodic waveform outputs from the sensor 250 that have not been adjusted or modified by the module 253. As such, the controller 202 may receive outputs directly from the sensor 250 even when the module is included 253. These outputs may thus not be compensated for changes in exhaust pressure. As such, fluctuations in these raw sensor outputs may be used by the controller 202 to estimate exhaust pressure even when the module 253 is included. As such, the AFR sensor 250 may be directly electrically coupled to the controller 202 even when the AFR sensor module 253 is included. As such, the AFR sensor 250 may be directly electrically coupled to the controller 202 and to the module 253. The module in turn may also be directly electrically coupled to the controller 202. However, the controller 202 may use the input received directly from the AFR sensor 250 to estimate exhaust pressure, and may use the adjusted AFR sensor output received from the AFR sensor module 253 to determine the amount of fuel to be injected by the injectors 266.

However, in other examples where the module 253 is not included, the LAMBDA signal may vary under substantially constant oxygen concentrations if the exhaust pressure is changing. Thus, the LAMBSE signal will correspondingly change due to changes in the exhaust pressure. As explained in greater detail below with reference to FIGS. 3-5, the controller 202 may estimate the exhaust pressure based on the raw voltage output from the AFR sensor 250. However, in examples, where the module 253 is not included, the controller 202 may additionally or alternatively estimate the exhaust pressure based on the LAMBSE signal 216.

Figure 3:
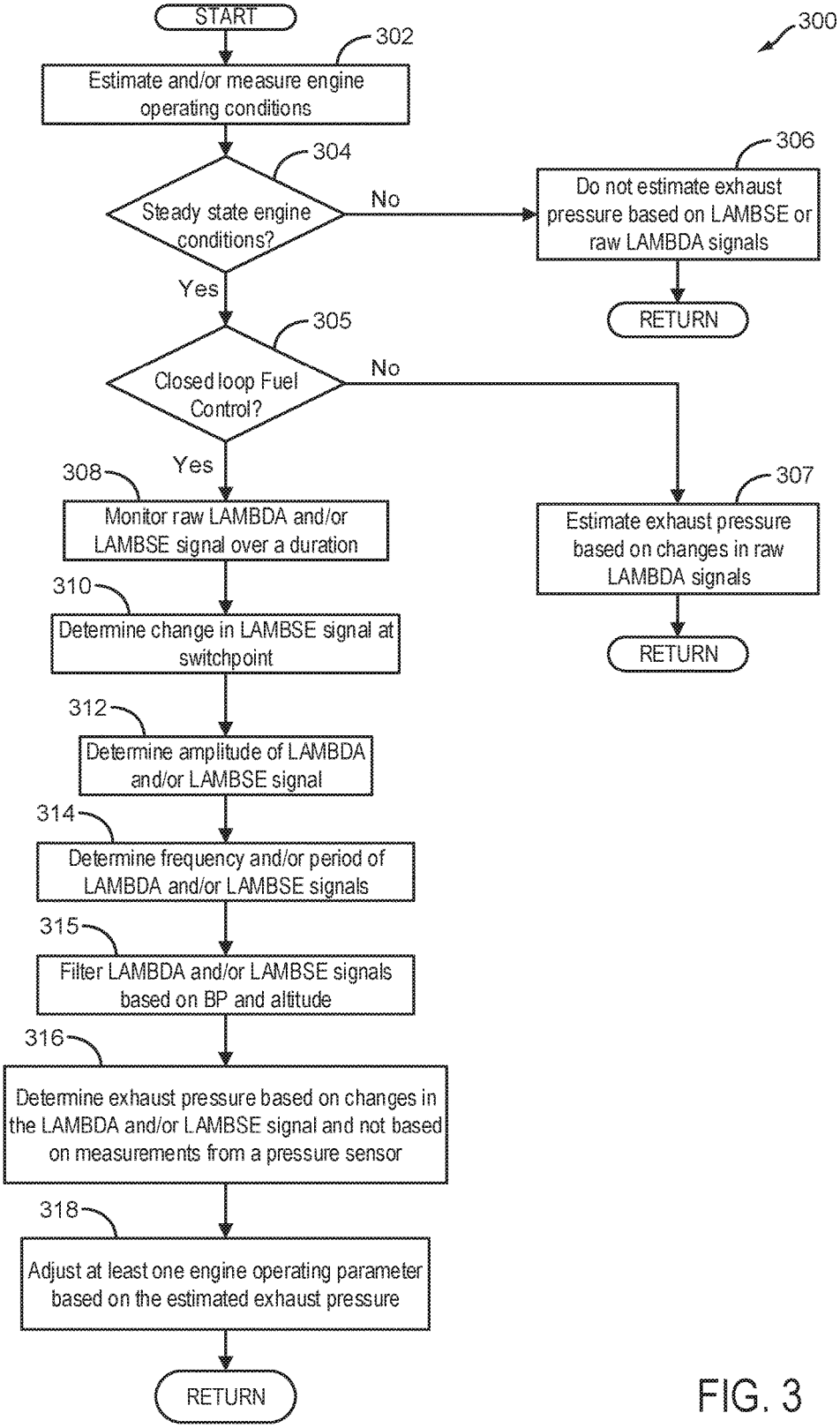
FIG. 3 shows a flow chart of an example method for estimating exhaust pressure based on outputs from an exhaust air/fuel ratio sensor, such as the example air/fuel ratio sensor shown in FIG. 1, in accordance with an embodiment of the present disclosure.

Turning now to FIG. 3, it shows an example method 300 for estimating exhaust pressure based on outputs from an exhaust AFR sensor (e.g., AFR sensor 126 described above in FIG. 1). Instructions for carrying out method 300 may be executed by a controller (e.g., controller 12 described above in FIG. 1) based on instructions stored on a memory of the controller and in conjunction with signals received from sensors of the engine system, such as the sensors described above with reference to FIG. 1. The controller may employ engine actuators of the engine system to adjust engine operation, according to the methods described below.

Method 300 begins at 302 which comprises measuring and/or estimating engine operating conditions. Engine operating conditions may include one or more of a fuel injection amount, desired air/fuel ratio, boost pressure, position of an intake throttle (e.g., throttle 62 described above in FIG. 1), exhaust pressure, loading of a particulate filter (e.g., particulate filter 82 described above in FIG. 1), engine speed, etc.

After estimating and/or measuring engine operating conditions, method 300 may continue from 302 to 304 which comprises determining if steady state engine conditions exist. Steady state engine conditions may include conditions where the engine speed and/or driver demanded torque remain substantially the same for a threshold duration. Thus, the method 300 at 304 may comprise determining if one or more of the driver demanded torque and/or engine speed remain within a threshold range for a threshold duration. The driver demanded torque may be estimated based on a position of an accelerator pedal (e.g., input device 132 described above in FIG. 1) as provided by a pedal position sensor (e.g., pedal position sensor 134 described above in FIG. 1). Engine speed may be provided by an engine speed sensor, such as Hall effect sensor 118 described above in FIG. 1. If the engine speed and/or driver demanded torque fluctuate outside the threshold range then it may be determined that steady state conditions do not exist. If steady state engine conditions do not exist, method 300 continues from 304 to 306 which comprises not estimating the exhaust pressure based on LAMBSE or LAMBDA signals. As described above with reference to FIG. 2, the LAMBSE signal represent a commanded fuel injection amount and the raw LAMBDA signal represent the voltage output from the AFR sensor that is not compensated for pressure. Method 300 then returns.

Returning to 304, if it is determined that steady state engine conditions do exist, then method 300 may continue from 304 to 305 which comprises determining if closed loop fuel control is occurring. That is, the method 300 at 305 may comprise determining if fuel control is feedback controlled by the controller based on outputs from the AFR sensor. The controller may switch between closed loop and open loop fuel control under varying engine operating conditions. For example, during deceleration fuel shut-off, the controller may switch to open loop fuel control. During open loop fuel control, the controller may not adjust the fuel injection amount based on outputs from the AFR sensor, and may inject a desired amount of fuel based on the mass airflow rate and a look-up table relating mass airflow rates to desired fuel injection amounts.

If it is determined that closed loop fuel control is not occurring, and that the fuel control system is operating in open loop control, then method 300 may continue from 305 to 307 which comprises estimating the exhaust pressure based on changes in the raw LAMBDA signal. During steady state engine operating conditions, where the mass airflow and driver demanded torque are substantially the same, the commanded fuel injection amount during open loop control may remain substantially the same. Thus, fluctuations in the raw LAMBDA output from the AFR sensor may be the result of fluctuating exhaust pressures. As such, the exhaust pressure may be inferred based on changes in the raw AFR sensor output during open loop fuel control, when the mass airflow rate in the engine intake is substantially constant. The exhaust pressure may be determined to increase for increases in the amount of oxygen indicated in the raw LAMBDA output from the AFR sensor, and may decrease for decreases in the amount of oxygen indicated in the raw LAMBDA output from the AFR sensor. Thus, the exhaust pressure may increase for decreases in the voltage output by the AFR sensor, and vice versa.

However, in other examples, the method 300 at 307 may comprise not estimating the exhaust pressure, and freezing estimates of the exhaust pressure. Thus, in some examples, the exhaust pressure may only be estimated during closed loop air/fuel ratio control, and may not be updated or estimated during open loop control. That is, the value of the most recent exhaust pressure estimate prior to entering open loop air/fuel ratio control may be used as the estimate of the exhaust pressure for the duration of the open loop air/fuel ratio control period. Method 300 then returns.

If it is determined that the fuel control system is in closed loop fuel control, then method 300 may continue from 305 to 308 which comprises monitoring the raw LAMBDA signal and/or LAMBSE signal over a duration. As described above, the raw LAMBDA signal corresponds to the voltage output by the AFR sensor that represents an amount of oxygen in the exhaust gas. The raw LAMBDA signal is not pressure compensated, and is thus not altered or generated by an AFR sensor module, such as AFR sensor module 253 described above in FIG. 2 that adjusts the raw LAMBDA signal based on exhaust pressure.

In some examples, the duration at 308 may be an amount of time (e.g., a time interval). In another example, the duration may be a number of cycles of the LAMBDA and/or LAMBSE signals. As depicted in FIGS. 4A-4D, the LAMBDA and LAMBSE signals may be periodic waveform signals. The frequency and amplitude of the LAMBDA and/or LAMBSE signals may change as the exhaust pressure fluctuates. However, the LAMBDA and LAMBSE signals may maintain a periodic waveform shape during closed loop fuel control, as the commanded fuel injection amount oscillates back and forth between richer and leaner values of the desired air/fuel ratio (e.g., stoichiometry). The duration may in some examples be exactly one cycle (e.g., one period) of the LAMBDA and/or LAMBSE signals. In another example, the duration may be at least one cycle of the LAMBDA and/or LAMBSE signals. In another example, the duration may a switching cycle, which is half of the LAMBDA and/or LAMBSE signals. In yet further examples, the duration may be more than two LAMBDA and/or LAMBSE cycles. In yet further examples, the duration may be a number of engine cycles, a number of cylinder cycles, etc. For example, the duration may be comprise a cycle of one of the engine cylinders. In another example, the duration may comprise the cycles of two or more engine cylinders. In yet further examples, the duration may comprise an entire engine cycle where all of the engine cylinders complete one cycle. In yet further examples, the duration may comprise more than one engine cycle.

After monitoring the raw LAMBDA and/or LAMBSE signals over the duration, method 300 continues from 308 to 310 which comprises determining the change in the LAMBSE signal at a switchpoint. As described in greater detail below with reference to FIGS. 4A-4D, the LAMBSE signal switchpoint may comprise the time at which when the LAMBDA signal switches from lean of the set point to rich of set point and thus results in the LAMBSE signal switching from rich of stoichiometry to lean of stoichiometry, and vice versa. A set point for the LAMBDA signal may be assigned by the controller. The LAMBDA signal may be compared to this setpoint to determine the LAMBSE signal. In particular, the deviation between the current LAMBDA signal and the setpoint may be used to generate proportional and integral terms used in the feedback control loop to generate the LAMBSE signal, as described above with reference to FIG. 2.

When the LAMBDA signal is leaner than the setpoint, then the LAMBSE signal may command for an increase in fuel injection to enrich the air/fuel ratio (e.g., decrease the air/fuel ratio). Conversely, when the LAMBDA signal is richer than the setpoint, then the LAMBSE signal may command for a decrease in fuel injection to enlean the air/fuel ratio (e.g., increase the air/fuel ratio). In some examples, the set point may represent an approximately stoichiometry air/fuel ratio. However, in some examples, the set point may be adjusted to run the engine richer or leaner than stoichiometry.

The change in LAMBSE at the switchpoint may comprise the amount that the LAMBSE signal changes at, or within a threshold duration of, the switch of the LAMBDA signal from either rich to lean of the setpoint, or from lean to rich of the setpoint. In some examples, the method 300 at 310 may comprise determining the change in the LAMBSE signal at only one switchpoint during the duration at which the LAMBSE signal was monitored. In another examples, the method 300 at 312 comprise calculating the change in the LAMBSE signal at two or more of the switchpoints included within the duration of the LAMBSE signal that was monitored at 308. In yet a further example, the method 300 at 310 may comprise calculating the change in the LAMSE signal at every one of the switchpoints included within the duration of the LAMBSE signal that was monitored at 308. In yet further examples, the method 300 at 310 may comprise computing the average change in the LAMBSE signals at two or more of the switchpoints included within the duration of the LAMBSE signal that was monitored at 308.

Method 300 may then continue from 310 to 312 which comprises determining the amplitude of the LAMBDA and/or LAMBSE signals. In some examples, the method 300 may comprise determining the amplitude of the LAMBDA and/or LAMBSE signals for only one cycle of the one or more signals. In another examples, the method 300 may comprise computing the amplitude for each cycle of two or more cycles of the LAMBDA and/or LAMBSE signals included within the duration. In yet another examples, the method 300 may comprise averaging the amplitudes of the LAMBDA and/or LAMBSE signals over the duration, or for portions of the duration. In another example, the method 300 at 312 may comprise determining the magnitude of the difference between a peak and trough of a cycle of the LAMBDA and/or LAMBSE signals. In another examples, averaging the magnitude of the difference between peaks and troughs of two or more cycles of the LAMBDA and/or LAMBSE signals during the duration. The method 300 at 312 may additionally or alternatively comprise calculating the standard deviation of the LAMBSE and LAMBDA signals. The standard deviation may be calculated over one or more of the entire duration, a portion of the duration, a single cycle, multiple cycles, or a portion of a cycle of the signals.

Method 300 may then continue to 314 which comprises determining the frequency and/or period of the LAMBDA and/or LAMBSE signals. The period may be the amount of time for the LAMBDA and/or LAMBSE signal to complete one cycle. However, in some examples, the method 300 at 314 may comprise determining the frequency and/or period of the LAMBDA and/or LAMBSE switching cycles. As described above in 312 and 310, the frequency and/or periods of the LAMBDA and/or LAMBSE signals may be computed for each cycle, portions of cycle, multiple cycles, and/or may be averaged over multiple cycles, etc.

Method 300 may then continue from 314 to 315 which comprise filtering the LAMBDA and/or LAMBSE signals based on one or more of barometric pressure and altitude.

Method 300 may then continue from 315 to 316 which comprises determining the exhaust pressure based on changes in the LAMBDA and/or LAMBSE signals and not based on measurements from an exhaust pressure sensor. Thus, in some examples, the exhaust pressure may be estimated based only on outputs from the AFR sensor. In some examples the controller may include a look-up table relating one or more of the frequency, period, amplitude, etc., of the LAMBDA and/or LAMBSE signals to exhaust pressures. Thus, based on one or more of the amplitude, frequency, period, etc. of the LAMBDA and/or LAMBSE signals, the controller may determine the exhaust pressure based on the look-up table. In another example, the controller may determine the exhaust pressure based on changes in one or more of the frequency, period, and amplitude of the LAMBDA and/or LAMBSE signals over the duration. For example, the exhaust pressure may increase for one or more of increases in the amplitude of the LAMBDA and/or LAMBSE signals, increases in the frequency and therefore decreases in the period of the LAMBDA and/or LAMBSE signals. Thus, the controller may look for trends in the LAMBDA and/or LAMBSE signals over the duration, and may use the relative changes in the signals over the duration, to determine fluctuations in the exhaust pressure.

Method 300 may then continue from 316 to 318 which comprises adjusting at least one engine operating parameter based on the estimated exhaust pressure. For example, the method 300 at 318 may comprise adjusting one or more of an intake throttle (e.g., intake throttle 62 described above in FIG. 1), a wastegate valve (e.g., wastegate valve 168 described above in FIG. 1), and a particulate filter heater (e.g., heater 84 described above in FIG. 1). For example, the controller may adjust the wastegate valve to a more open position in response to increases in the exhaust pressure. In another example, the controller may adjust the intake throttle to a more closed position in response to increases in the exhaust pressure. In yet another example, the controller may initiate regeneration of the particular filter and may power on the heater when the exhaust pressure exceeds a threshold and the particulate filter load is greater than a threshold. Closing the intake throttle, opening the wastegate and regenerating the particulate filter may reduce exhaust pressure. For example, the controller may adjust the positions of the wastegate and/or intake throttle via adjustment of a pulse width modulated signal sent from the controller to respective actuators of the valves. The controller may power on the particulate filter heater, via a pulse width modulated signal that may be sent to a power source of the heater, for increasing an amount of power supplied to the heater. Method 300 then returns.

Turning now to FIGS. 4A-4D, they show four example graphs depicting raw outputs from an exhaust AFR sensor (e.g., AFR sensor 126 described above in FIG. 1) under varying exhaust pressures during closed loop fuel control. Thus, the graphs in FIGS. 4A-4D show different examples of how exhaust pressure may affect the outputs of the AFR sensor during closed loop fuel control, where a commanded amount of fuel to be injected into one or more engine cylinders is adjusted based on the AFR sensor output. Further, the graphs in FIGS. 4A-4D show changes in a commanded fuel injection amount (LAMBSE) during closed loop fuel operation. Thus, the LAMBSE signal may be generated based on the outputs from the AFR sensor to achieve a desired air/fuel ratio. Example changes in the exhaust pressure are shown in plots 402, 412, 432, and 452 in graphs 400, 425, 450, and 475, respectively. Further, example changes in the AFR sensor output are shown in plots 404, 414, 434, and 454 in graphs 400, 425, 450, and 475, respectively. Example changes in the LAMBSE signal are shown in plots 406, 416, 436, and 456 in graphs 400, 425, 450, and 475, respectively.

The exhaust pressure AFR sensor output and LAMBSE signal output in FIGS. 4A-4D are plotted along a horizontal time axis. Along the vertical axis, the AFR sensor output may decrease in voltage for increases in the amount of oxygen. The LAMBSE signal may increase in richness for increases in the amount of fuel commanded to be injected by the signal.

The setpoint of the AFR sensor, which is the point to which the AFR sensor output is compared to generate the LAMBSE signal is shown as dotted line 405 in graphs 400, 425, 450, and 475. The setpoint may represent an approximately stoichiometric mixture in examples where the desired air/fuel ratio is set to stoichiometry. Thus, the setpoint may represent a predicted AFR sensor output which would be expected when the actual air/fuel ratio matches the desired air/fuel ratio. Thus, when the AFR sensor output matches the setpoint, the desired air/fuel ratio may be achieved. When the AFR sensor registers more oxygen than would be present at the desired air/fuel ratio (is above dotted line 405), the exhaust mixture may be leaner than desired. Conversely, when the AFR sensor registers less oxygen than would be present at the desired air/fuel ratio (is below dotted line 405), the exhaust mixture may be richer than desired.

Further, the amount of fuel that would be commanded to achieve the desired air/fuel ratio is shown as dotted line 407 in graphs 400, 425, 450, and 475. When the AFR sensor registers a leaner than desired mixture, the LAMBSE signal may command for a richer than desired fuel injection amount to bring the air/fuel ratio closer to the desired air/fuel ratio. Thus, the LAMBSE signal may be richer than stoichiometry (is above dotted line 407) when the AFR sensor registers a leaner than desired mixture. When the air/fuel ratio is richer than desired, the LAMBSE signal may command for less fuel to be injected to bring the air/fuel ratio closed to the desired air/fuel ratio. Thus, the LAMBSE signal may be leaner than stoichiometry (is below the dotted line 407) when the AFR sensor registers a richer than desired mixture. Thus, as depicted in the graphs in FIGS. 4A-4D, the LAMBDA and LAMBSE signals may cycle back and forth between enleanment and enrichment in a periodic waveform manner.

As shown in FIGS. 4A-4D, the AFR sensor output and the LAMBSE signals may comprise periodic waveforms during closed loop fuel control. Each cycle of the AFR sensor output signal comprises a crest (a maximum value that represents a maximum enrichment value) and a valley (a minimum value of the signal that represents a maximum enleanment value). The crests and valleys for different cycles of the AFR sensor may change depending on the exhaust pressure. The period of an example single cycle is shown by $\lambda_S$. Thus $\lambda_S$ denotes the period or wavelength of the AFR sensor output signal. Further, the amplitude of the signal is shown by $\lambda_s$. The amplitude may be half of the difference or distance between successive crests and valleys. The deviation may be defined as the total difference or distance between successive crests and valleys, or twice the amplitude.

Similarly, each cycle of the LAMBSE signal may comprise a trough (a minimum value) and a peak (a maximum value). The troughs and peaks for different cycles of the AFR sensor may change depending on the exhaust pressure. The period of an example single cycle of the LAMBSE signal is shown by $\lambda_{L2}$. Thus $\lambda_{L2}$ denotes the period or wavelength of the LAMBSE signal. As described above, the LAMBSE signal switches from rich of stoichiometry to lean of stoichiometry or vice versa when the AFR sensor output crosses the setpoint. In particular, when the AFR sensor output switches from leaner than the setpoint to richer than the setpoint, the LAMBSE signal switches rich of stoichiometry to lean of stoichiometry. Conversely, the LAMBSE signal switches from lean of stoichiometry to rich of stoichmetry when the AFR sensor output switches from richer than the setpoint to leaner exhaust than the setpoint. Two example successive switchpoints are labeled in FIG. 4A. The period between two successive switchpoints may be defined herein as the switching period $\lambda_{L1}$. Thus, the switching frequency may be used to define as the rate at which the LAMBSE signal switches between lean of stoichiometry and rich of stoichiometry. Said another way, the switching frequency may be used to define the number of switchpoints that occur within a unit time, where increases in the switching frequency correspond to increases in the number of swtichpoints that occur within a unit time.

Further, at the switchpoint, the LAMBSE signal may overshoot stoichiometry by a pre-set amount. The amount that the LAMBSE signal overshoots stoichiometry may be referred to as the fuel offset. Thus, the fuel offset may be the distance between stoichiometry and the LAMBSE signal at the end of the switchpoint as labeled in FIG. 4A. A first amplitude of the LAMBSE signal is shown by $\lambda_{L1}$. The first amplitude may be the difference or distance between a peak and/or trough and dotted line 407 (e.g., stoichiometry). A second amplitude of the LAMBSE signal is shown by $\lambda_{L2}$. The second amplitude of the LAMBSE signal may be the difference or distance between a peak or trough and the successive fuel offset at the switchpoint. Thus, at a switchpoint, the LAMBSE signal may switch from either a trough (maximum lean value) to a value rich of stoichiometry by an amount defined by the fuel offset, or from a peak (maximum rich value) to a value lean of stoichiometry be an amount defined by the fuel offset. Further, the deviation in a cycle of the LAMBSE signal may be defined as the total difference or distance between successive troughs and peaks.

Further, the standard deviation of the LAMBSE and AFR sensor output signals may be defined as the amount of deviation in the signals. Thus, for increases in the standard deviation of the signals, the amplitude or deviation of the cycles of the signals may increase. That is the spread between minimum and maximum values for each of the cycles of the signals may increase for increases in the standard deviation of the signals. In this way, the standard deviation of multiple cycles of the LAMBSE signal and/or the AFR sensor output signal may be used to determine the average spread in the signals over the samples cycles. Further, one or more of the standard deviation, amplitude, frequency, period, wavelength, etc., of a single or multiple cycles of the AFR sensor output signal may be compared to other single or multiple cycles of the AFR sensor output signal to determine changes in the exhaust pressure. Similarly, one or more of the standard deviation, amplitude, frequency, period, wavelength, etc., of a single or multiple cycles of the LAMBSE signal may be compared to other single or multiple cycles of the LAMBSE signal to determine changes in the exhaust pressure.

Figure 4A:
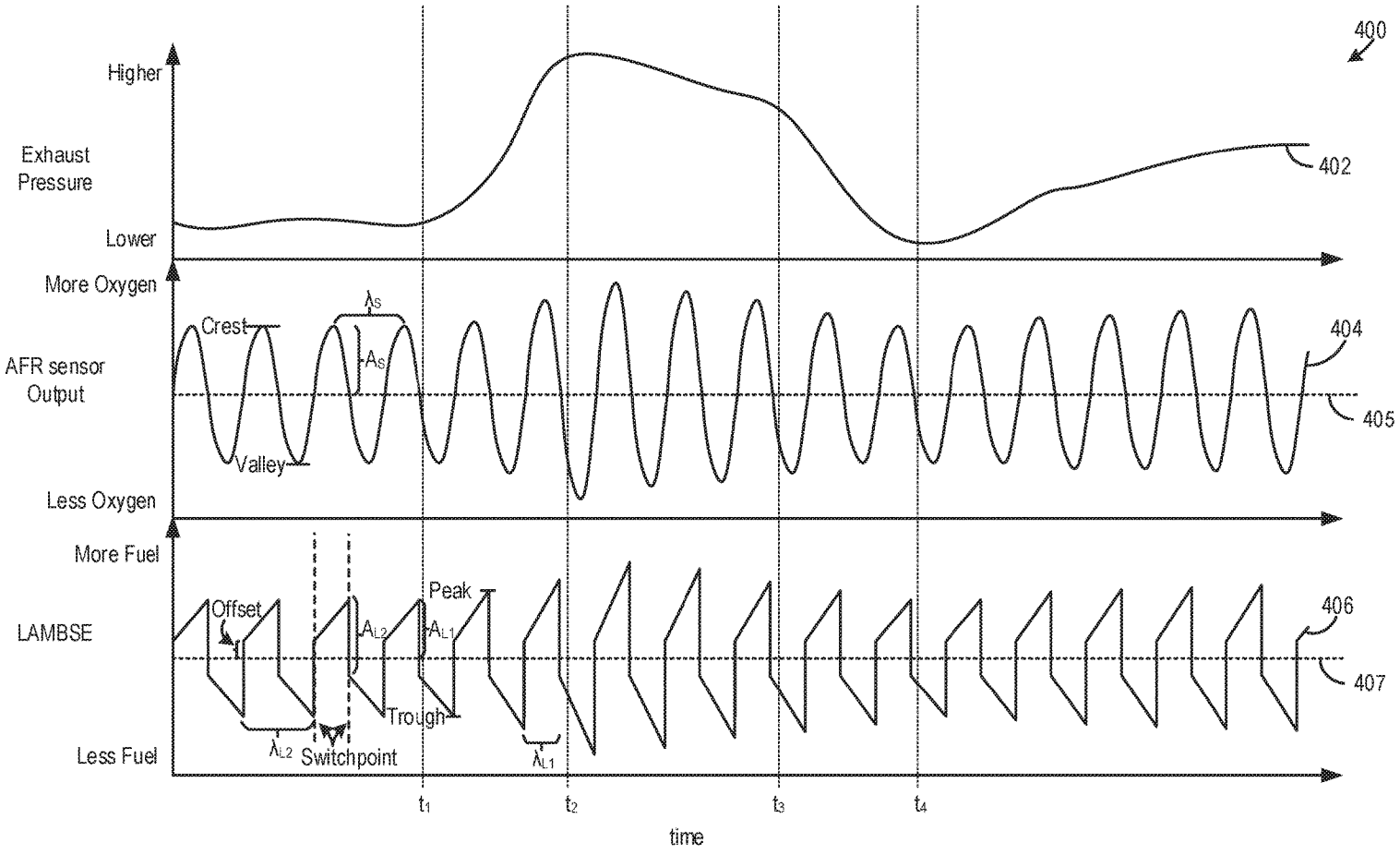
FIG. 4A shows a first graph depicting changes in exhaust air/fuel ratio sensor outputs and commanded fuel injection amounts from a fuel controller under varying exhaust pressures.

For example, turning first to FIG. 4A, it shows a first embodiment of how the AFR sensor outputs and/or LAMBSE signal may be affected under varying exhaust pressures. In particular, FIG. 4A shows how the standard deviation or amplitude of the AFR sensor output and/or LAMBSE signals may be affected under varying exhaust pressures. The standard deviation and/or amplitude of the AFR sensor output increases for increases in the exhaust pressure. That is, the crests and/or valleys may increase in distance from the setpoint 405 as the exhaust pressure increases. Thus, the exhaust pressure may be inferred based on the standard deviation and/or amplitude of the AFR sensor output. For example, a controller (e.g., controller 12 described above in FIG. 1) may monitor the AFR sensor output before $t_1$ to after $t_4$. In one example, the controller may calculate the standard deviation of the AFR sensor output before $t_1$ when the exhaust pressure is substantially constant. Then, at $t_1$, the exhaust pressure may begin to increase. The controller may continue to compare the standard deviation of one or multiple cycles of the AFR sensor output after $t_1$ to determine an amount of increase in the exhaust pressure. As described above with reference to FIG. 3, the controller may instantaneously and continuously update estimates of the exhaust pressure based on the most recent AFR sensor output. However, in other examples, the controller may update estimates of the exhaust pressure after a duration, such as a number of cycles of the AFR sensor output signal, based on the output received during the duration.

Similarly, the standard deviation of the LAMBSE signal may increase for increases in the exhaust pressure. Thus, the controller may estimate the exhaust pressure based on changes in the standard deviation of the LAMBSE signal in a similar manner to that described above for the AFR sensor output signal. Additionally, the controller may estimate the exhaust pressure based on changes in one or more of the first amplitude ($\lambda_{L1}$), the second amplitude ($\lambda_{L2}$), and the deviation of the LAMBSE signal. As the exhaust pressure increases, the first amplitude, the second amplitude, and the deviation of the LABMSE signal may increase as depicted in FIG. 4A.

Figure 4B:
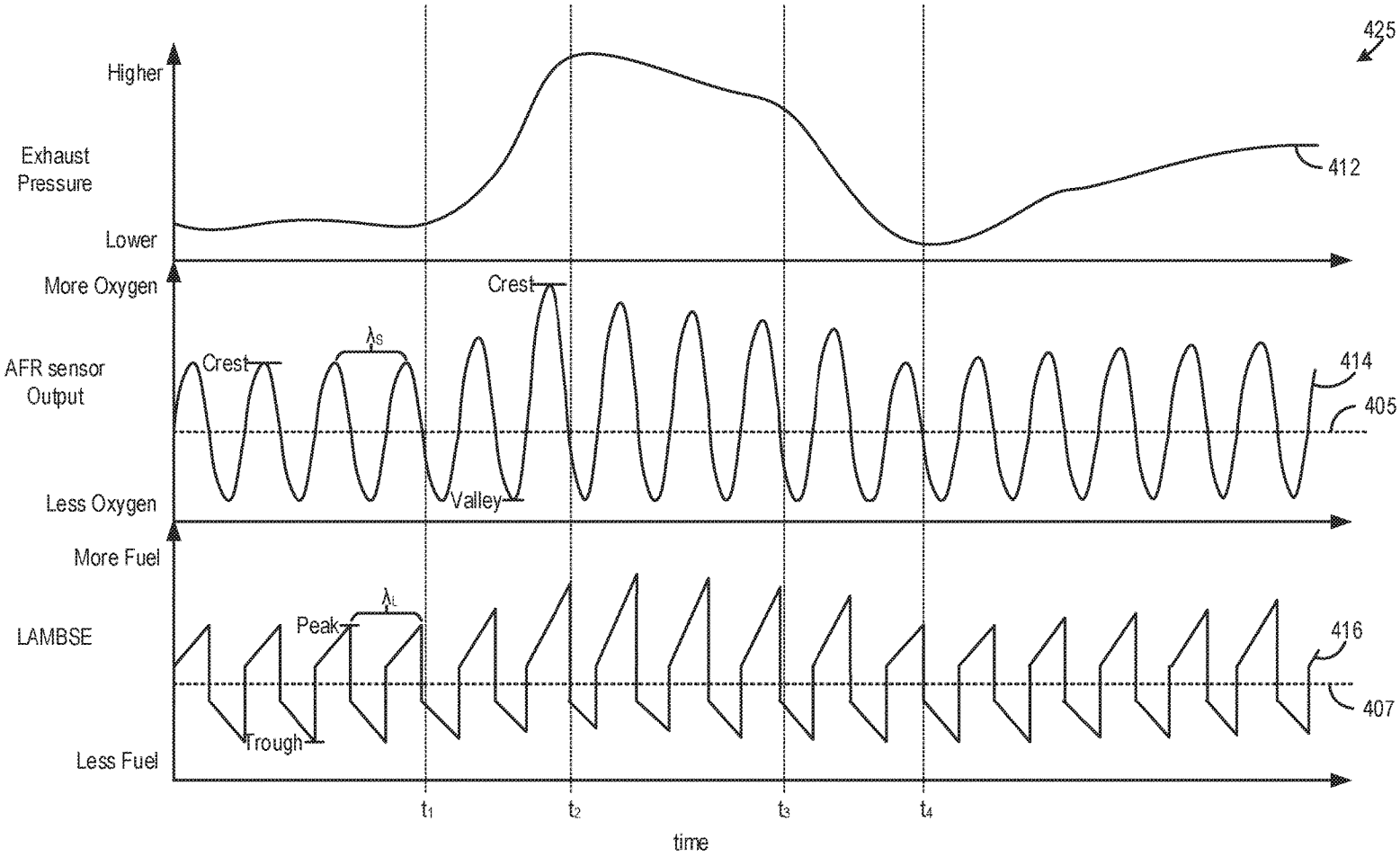
FIG. 4B shows a second graph depicting example changes in exhaust air/fuel ratio sensor outputs and commanded fuel injection amounts from a fuel controller under varying exhaust pressures.

Turning to FIG. 4B, it shows a second embodiment of how the AFR sensor output and/or LAMBSE signal may be affected under varying exhaust pressures. In the example of FIG. 4B, the standard deviation, and thus amplitude, of the AFR sensor output and the LAMBSE signal may increase for increases in the exhaust pressure. However, in the example of FIG. 4B, the AFR sensor output may be biased towards higher oxygen levels. That is, the amplitude of the crests and peaks may be greater than the valleys and troughs. Said another way, the AFR sensor output signal may be shifted towards leaner (higher oxygen) values at higher exhaust pressures. Thus, the average value of the AFR sensor output signal at higher exhaust pressures may be shifted towards a higher oxygen value than the average value of the AFR sensor output signal at lower exhaust pressures. As seen in FIG. 4B, the average value of the AFR sensor output signal between $t_2$ and $t_3$ is at a lower voltage (registers more oxygen) than the average value of the AFR sensor output signal before $t_1$.

Similarly, the average value of the LAMBSE signal at higher exhaust pressure may be shifted towards a richer value (more fuel) than the average value of the LAMBSE signal at lower exhaust pressures. As seen in FIG. 4B, the average value of the LAMBSE signal between $t_2$ and $t_3$ may be richer than the average value of the LAMBSE signal before $t_1$.

It should be appreciated that in other examples, the AFR sensor output may be biased towards lower oxygen levels. Thus, the amplitude of the crests and peaks may be less than the valleys and troughs. Said another way, the AFR sensor output signal may be shifted towards richer (lower oxygen) values at higher exhaust pressures. Thus, the average value of the AFR sensor output signal at higher exhaust pressures may be shifted towards a lower oxygen value than the average value of the AFR sensor output signal at lower exhaust pressures. Similarly, the LAMBSE signal may be shifted towards a leaner value (less fuel) than the average value of the LAMBSE signal at lower exhaust pressures, when the AFR sensor output signal is biased towards lower oxygen values at higher exhaust pressures.

Figure 4C:
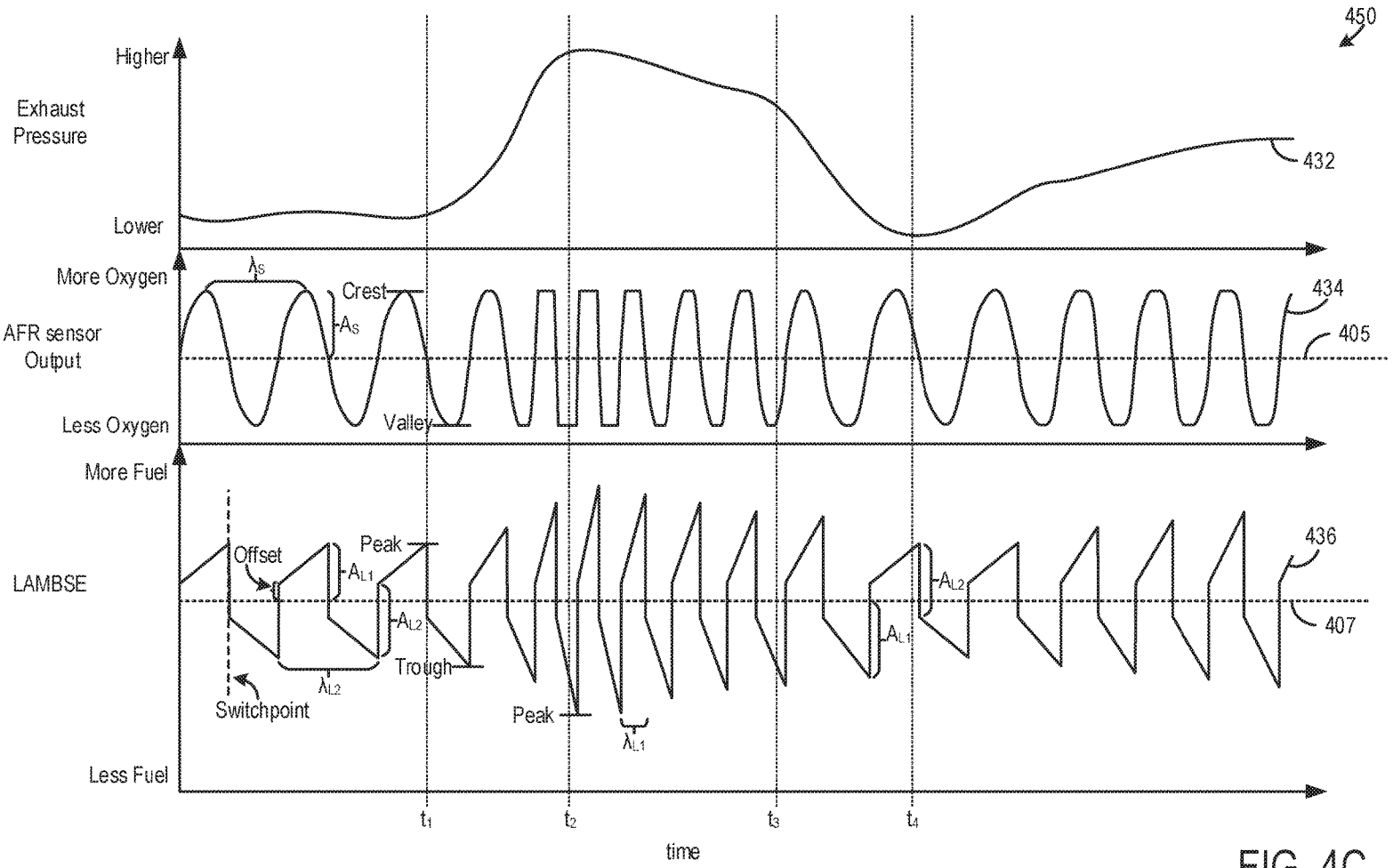
FIG. 4C shows a third graph depicting example changes in exhaust air/fuel ratio sensor outputs and commanded fuel injection amounts from a fuel controller under varying exhaust pressures.

FIG. 4C, shows a third embodiment of how the AFR sensor output and/or LAMBSE signal may be affected under varying exhaust pressures. In the example of FIG. 4C, the frequency of the AFR sensor output and the LAMBSE signals may increase for increases in the exhaust pressure. Thus, the wavelength and/or period of the AFR sensor output and LAMBSE signals may decrease for increases in the exhaust pressure. However, in the example of FIG. 4C, the amplitude of the AFR sensor output may not change under varying exhaust pressures. In the example of FIG. 4C, the AFR sensor may be a narrow band oxygen sensor such as an EGO or HEGO. Thus, the AFR sensor may saturate (may reach the crests and valleys) under low exhaust pressures. As such, at higher exhaust pressures, the AFR sensor may reach the crests and valleys more quickly, and as such the frequency of the LAMBSE switching cycles may increase. Thus, as seen between $t_2$ and $t_3$, where the exhaust pressure is higher than before $t_1$, the frequency of the AFR sensor output signal is higher than before $t_1$. However, the amplitude of the AFR sensor output signal may remain approximately the same.

The LAMBSE signal may increase in frequency for increases in the exhaust pressure, and may increase in standard deviation and/or amplitude for increases in the exhaust pressure. As depicted in plot 436, the LAMBSE signal has a higher frequency and greater standard deviation between $t_2$ and $t_3$ than before $t_1$. Thus, the first amplitude and second amplitude may also be greater between $t_2$ and $t_3$ than before $t_1$.

Figure 4D:
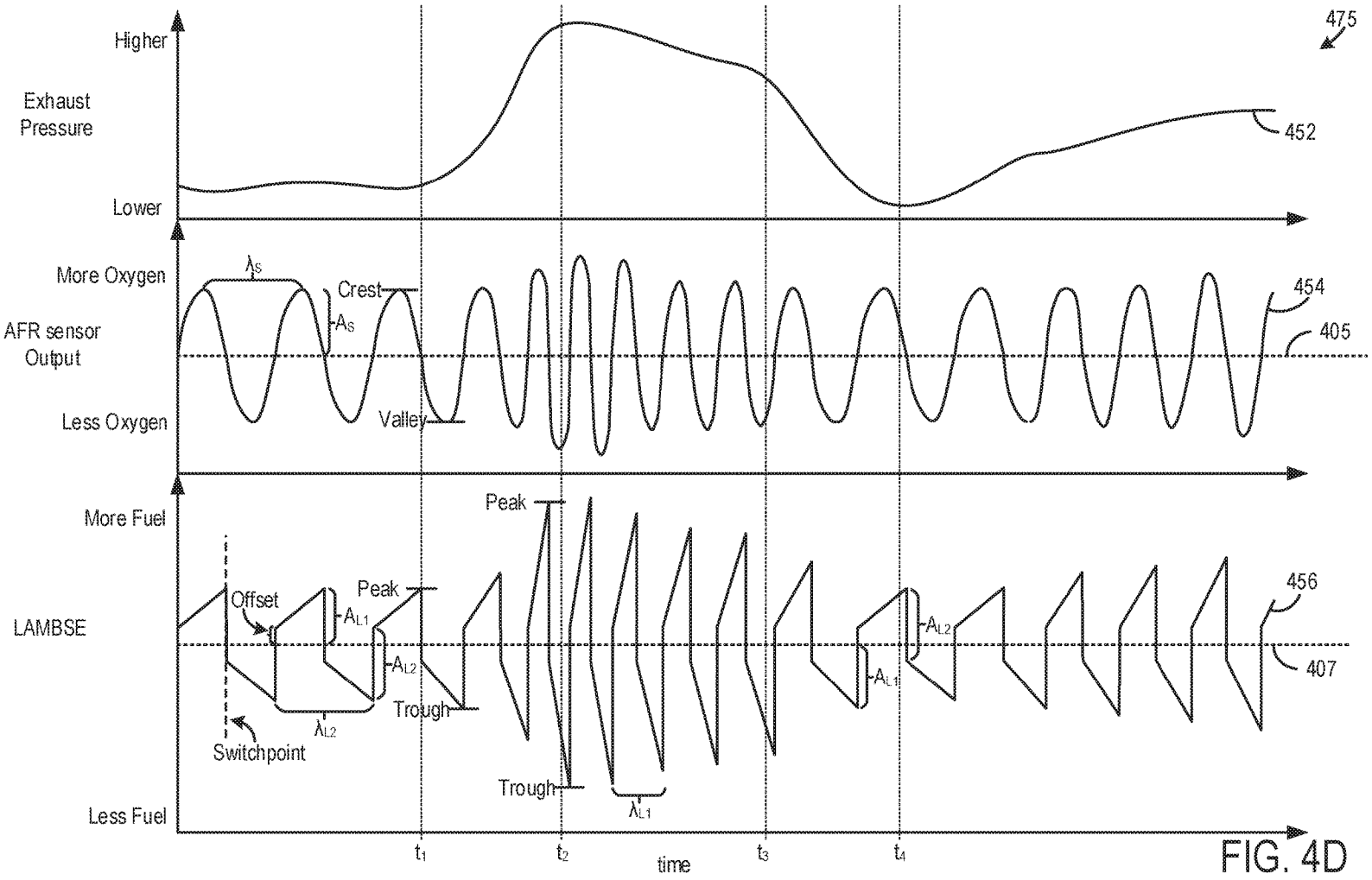
FIG. 4D shows a fourth graph depicting example changes in exhaust air/fuel ratio sensor outputs and commanded fuel injection amounts from a fuel controller under varying exhaust pressures.

Turning now to FIG. 4D, it shows a fourth embodiment of how the AFR sensor output and/or LAMBSE signal may be affected under varying exhaust pressures. In the example of FIG. 4D, the frequency and standard deviation/amplitude of the AFR sensor output and the LAMBSE signals may increase for increases in the exhaust pressure. In the example of FIG. 4D, as in the FIGS. 4A and 4B, the AFR sensor may be a wide band oxygen sensor such as a UEGO, and thus may measure a wider range of oxygen levels than the AFR sensor of FIG. 4C. As such, the amplitude and/or standard deviation of the AFR sensor outputs may be greater at higher exhaust pressure, such as between $t_2$ and $t_3$, than lower exhaust pressures such as before $t_1$. Further, the frequency of the frequency of the AFR sensor output signal and the LAMBSE signal may increase for increases in the exhaust pressure. Thus, the frequency of the switching cycles of the LAMBSE signal may increase for increases in the exhaust pressure. Thus, $\lambda_{L2}$ may decrease for increases in the exhaust pressure.

Figure 5:
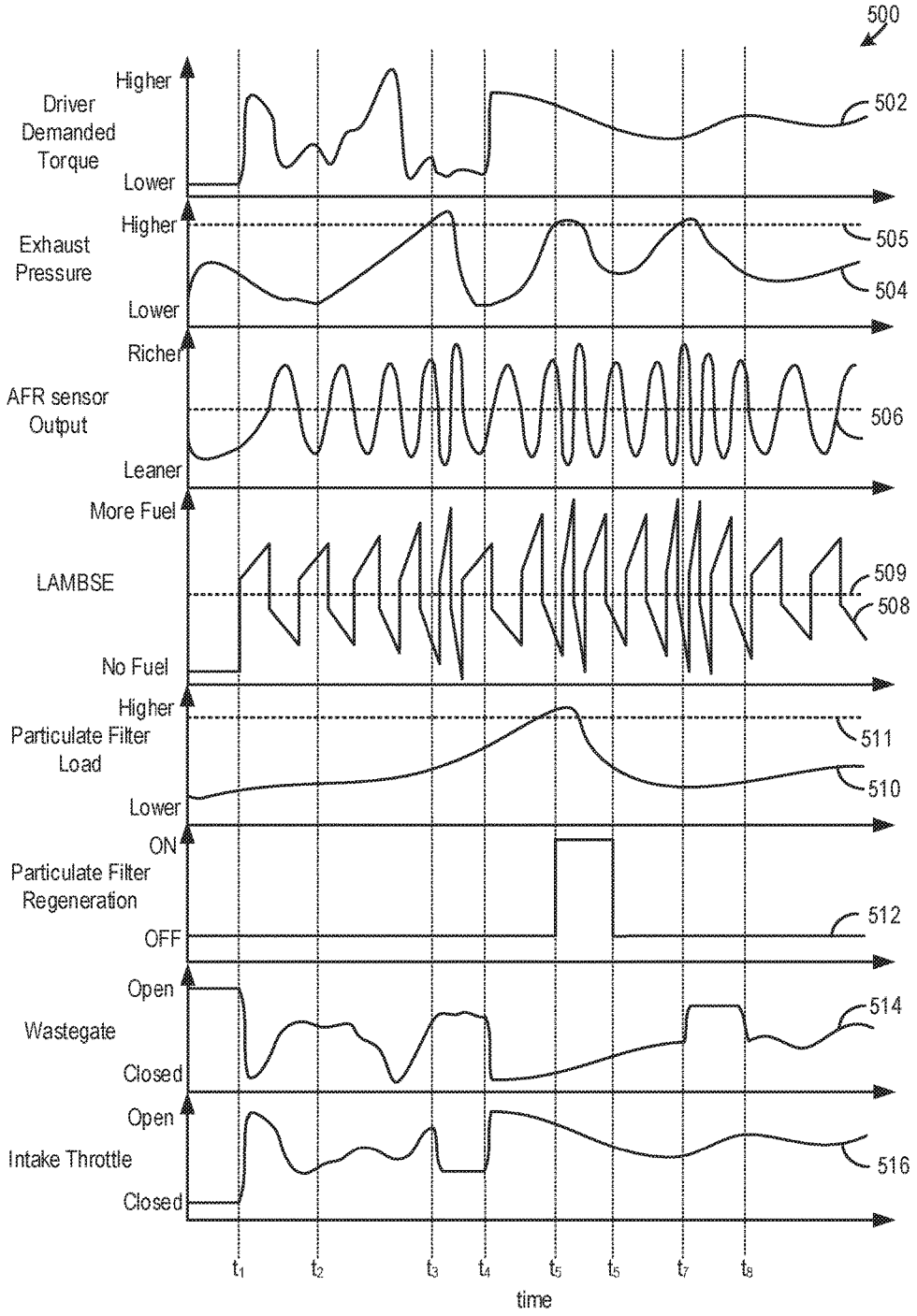
FIG. 5 shows a graph depicting example adjustments to various engine actuators under varying exhaust pressures.

Turning now to FIG. 5, it shows a graph 500 depicting example adjustments to various engine actuators under varying exhaust pressures. For example, one or more of a particulate filter regeneration may be initiated, an intake throttle valve may be adjusted to a more closed position, and/or a wastegate valve may be adjusted to more open position in response to increases in the exhaust pressure. Further, graph 500 depicts how changes in the exhaust pressure may affect outputs of an AFR sensor, as described in greater detail above with reference to FIGS. 4A-4D.

Plot 502 shows changes in a driver demanded torque which may be estimated based on input from a vehicle operator via an accelerator pedal (e.g., input device 132 described in FIG. 1). Plot 504 shows changes in exhaust pressure which may be estimated based on one or more of outputs from an AFR sensor (e.g., AFR sensor 126 described above in FIG. 1) and/or a fuel injection amount commanded by a fuel controller (LAMBSE signal). Threshold 505 represents a threshold exhaust pressure, above which a controller (e.g., controller 12 described in FIG. 1) adjusts various engine actuators to reduce the exhaust pressure. Plot 506 shows changes in outputs from the AFR sensor, and plot 508 shows changes in the LAMBSE signal. As described above in FIG. 2, the LAMBSE signal may comprise a commanded fuel injection amount, or a desired change in the commanded fuel injection amount. Dotted line 509 may represent a fuel injection setpoint which corresponds to a desired air/fuel ratio (e.g., stoichiometry). Thus, LAMBSE values above the dotted line 509 may correspond to a richer than stoichiometric mixture, and LAMBSE values below the dotted line 509 may correspond to a leaner than stoichiometry mixture.

Plot 510 shows a load on a particulate filter (e.g., particulate filter 82 described above in FIG. 1). The loading may correspond to an amount of particulate matter accumulated on the filter. The particulate filter load may be estimated based on amount of time since a most recent regeneration of the filter, and/or based on a pressure drop across the filter. In further examples, the particulate filter load may be estimated based on the estimated exhaust pressure, which may be estimated based on outputs from the AFR sensor. In particular, as the particulate filter becomes more loaded with particulate matter, flow through the filter may become more restricted, increasing the exhaust pressure upstream of the filter. As such, the loading of the filter may increase for increases in the exhaust pressure. Plot 512 shows changes in regeneration of the filter. As described above in FIG. 1, the filter may be regenerated by powering on a heater and burning the particulate matter accumulated on the filter. Threshold 511 may represent a loading level of the particulate filter, above which regeneration of the filter may be initiated. Plot 514 shows changes in the position of a wastegate valve (e.g., wastegate valve 168 described above in FIG. 1), and plot 516 shows changes in the position of an intake throttle (e.g., intake throttle 62 described above in FIG. 1).

Beginning before $t_1$, the driver demanded torque may substantially low. For example, the driver may not be depressing the accelerator pedal before $t_1$, and the vehicle may be in a deceleration fuel shut-off mode. Thus, fuel may not be injected into the engine before $t_1$. Fuel control may be open loop before $t_1$. That is, the LAMBSE signal may be generated based on a pre-set fueling amount (e.g., zero) and may not be based on output from the AFR sensor. As such the intake throttle may be substantially closed, and the mass airflow to the engine may be substantially constant (e.g., zero). However, in other examples, the intake throttle may be adjusted to an open position to reduce pumping losses. Thus, the LAMBSE signal may command for no fuel to be injected. However, the exhaust pressure may increase before $t_1$. Due to the increase in exhaust pressure, the partial pressure of oxygen may increase, and thus the amount of oxygen registered by the AFR sensor may increase. As such, the exhaust pressure may be inferred based on changes in the AFR sensor output during open loop fuel control and steady state engine operating conditions. As explained above with reference to FIG. 3, during open loop fuel control and steady state engine operating conditions, the mass airflow rates and fuel injection rates may remain substantially the same. Thus, changes in the AFR sensor output may be correlated to changes in the exhaust pressure. However, in other examples, it should be appreciated that the estimate of the exhaust pressure may be frozen and may not be updated when the controller enters open loop control of air/fuel ratio. As seen before $t_1$, the AFR sensor output may register more oxygen (e.g., leaner exhaust mixtures) as the exhaust pressure increases. Due to the DFSO conditions before $t_1$, the wastegate valve may remain open such that the turbocharger remains off. The particulate filter load may be below the threshold 511 and thus particulate filter regeneration may be off.

At $t_1$, the driver demanded torque may increase and the DFSO mode may be terminated. The intake throttle may be opened and the wastegate valve may be adjusted to a more closed position to increase an amount of boost provided by the turbocharger. Additionally, the fuel control may be switched to closed loop fuel control at $t_1$. From $t_1$ to after $t_8$, the exhaust pressure may be estimated based on the AFR sensor output and/or the LAMBSE signal. Additionally, from $t_1$ to $t_8$, the engine controller adjusts engine operating parameters, such as a position of the wastegate and/or intake throttle and regeneration of the particulate filter, based on the estimated exhaust pressure. For example, at $t_3$, the controller actuates an actuator of the intake throttle to decrease an amount of opening of the throttle in response to the previous increase in estimated exhaust pressure. As a result, exhaust pressure decreases between $t_3$ and $t_4$. As another example, at $t_5$, in response to the particulate filter load being over the threshold 511 and the exhaust pressure being over threshold 505, the controller activates particulate filter regeneration. In one example, the controller may activate particulate filter regeneration by actuating a heater of the particulate filter to turn on. As the particulate filter is regenerated, the exhaust pressure decreases. As yet another example, at $t_7$, in response to the increase in the exhaust pressure, the controller increases the amount of opening of the wastegate, thereby decreasing the exhaust pressure between $t_7$ and $t_8$.

In this way, the exhaust pressure may be estimated based on outputs from an AFR sensor, such as an exhaust oxygen sensor. In particular, the exhaust pressure may be estimated based on characteristics of the periodic waveform signal output by the AFR sensor during closed loop fuel control, where the characteristics of the waveform signal may comprise one or more of the standard deviation, frequency, and amplitude of the periodic waveform signal. The characteristics of the waveform signal may be calculated over a duration. In some examples, the duration may comprise a single cycle of the waveform signal, and in other examples, the duration may comprise multiple cycles of the waveform signal. Thus, in some examples, the frequency, amplitude, and standard deviation may be calculated for each cycle of the waveform signal, and in other examples, may be averaged over multiple cycles.

The exhaust pressure may then be estimated for the duration over which the waveform characteristics were calculated based on a look-up table relating one or more of the standard deviation, frequency, and amplitude of the signal to exhaust pressures. In other examples, the exhaust pressure may be estimated based on changes in the waveform characteristics over multiple durations. That is, the waveform characteristics may be calculated at regular binned intervals, and then the calculated waveform characteristics for each of the binned intervals may be compared to detect changes in the exhaust pressure. The exhaust pressure may increase monotonically with increasing frequency, standard deviation and amplitude of the waveform signal.

In some examples, where the commanded fuel injection amount calculated during closed loop fuel control is based on the raw output from the AFR sensor and not from pressure compensated outputs of the AFR sensor generated by a AFR monitoring module, the exhaust pressure may additionally or alternatively be estimated based on the commanded fuel injection signal (LAMBSE). The exhaust pressure may increase monotonically for increases in the switching frequency of the LAMBSE signal. Additionally, the exhaust pressure may increase monotonically for increases in the magnitude of the change of the LAMBSE signal at a switchpoint. Further, the exhaust pressure may increase monotonically for increases in the deviation or difference between successive minimum and maximum values of the LAMBSE signal.

A technical effect of reducing cost is achieved by estimating the exhaust pressure based on outputs from an AFR sensor instead of a pressure sensor. Thus, by inferring exhaust pressure from fluctuations in the AFR sensor outputs, an exhaust pressure sensor may not be included in the engine system, reducing the cost and complexity of the engine system. Further, estimates of the exhaust pressure based on outputs from the AFR sensor may be more accurate than estimates inferred from mass airflow, as such estimates do account for exhaust restrictions such as particulate filter loading.

As one embodiment, a method comprises monitoring periodic waveform outputs of a fuel controller during closed loop fuel control; estimating an exhaust pressure based on the waveform outputs of the controller; and adjusting at least one engine operating parameter based on the estimated exhaust pressure. In a first example of the method, the waveform outputs of the controller include a commanded fuel injection amount, and where the waveform outputs are generated by the controller based on feedback from an exhaust oxygen sensor. A second example of the method optionally includes the first example and further includes wherein the feedback from the exhaust oxygen sensor is directly received by the controller from the exhaust oxygen sensor and comprises raw output from the exhaust oxygen sensor that has not been adjusted by a control module for pressure. A third example of the method optionally includes one or more of the first and second examples, and further includes wherein the estimating the exhaust pressure based on the waveform outputs comprises estimating the exhaust pressure based on a frequency of the waveform outputs. A fourth example of the method optionally includes one or more of the first through third examples, and further includes wherein the estimated exhaust pressure monotonically increases for increases in the frequency of the waveform outputs. A fifth example of the method optionally includes one or more of the first through fourth examples, and further includes wherein the estimating the exhaust pressure based on the waveform outputs comprises estimating the exhaust pressure based on a magnitude of a change in the waveform outputs at a switchpoint, and where the estimated exhaust pressure monotonically increases for increases in the magnitude of the change in the waveform output at the switchpoint. A sixth example of the method optionally includes one or more of the first through fifth examples, and further includes wherein the estimating the exhaust pressure based on the waveform outputs comprises estimating the exhaust pressure based on a difference between a minimum value and a maximum value of a single cycle of the periodic waveform outputs, and where the estimated exhaust pressure monotonically increases for increases in the difference between the minimum and maximum values. A seventh example of the method optionally includes one or more of the first through sixth examples, and further includes wherein the adjusting the at least one engine operating parameter comprises opening a wastegate valve in response to the exhaust pressure increasing above a threshold. An eighth example of the method optionally includes one or more of the first through seventh examples, and further includes wherein the adjusting the at least one engine operating parameter comprises closing an intake throttle in response to the exhaust pressure increasing above a threshold. A ninth example of the method optionally includes one or more of the first through eighth examples, and further includes wherein the adjusting the at least one engine operating parameter comprises regenerating a particular filter in response to the exhaust pressure increasing above a threshold. A tenth example of the method optionally includes one or more of the first through ninth examples, and further includes wherein the estimating the exhaust pressure is based on the waveform outputs of the controller during at least a threshold duration where an intake mass airflow remains within a threshold range.

As another embodiment, a method for an engine comprises: monitoring periodic waveform outputs from an exhaust air/fuel ratio (AFR) sensor during closed loop fuel control; estimating an exhaust pressure based on one or more of a standard deviation and average frequency of cycles of the periodic waveform outputs; and adjusting at least one engine operating parameter based on the estimated exhaust pressure. In a first example of the method, the method further comprises, freezing the estimated exhaust pressure during open loop fuel control and not updating the estimated exhaust pressure based on one or more of the standard deviation and frequency of cycles of the periodic waveform outputs. A second example of the method optionally includes the first example and further includes monitoring outputs from the AFR sensor during open loop fuel control when an intake mass airflow is substantially constant; and estimating the exhaust pressure during the open loop fuel control when the intake mass airflow is substantially constant based on changes in an amount of oxygen measured by the AFR sensor, where the exhaust pressure increases monotonically for increases in the amount of oxygen measured by the AFR sensor. A third example of the method optionally includes one or more of the first and second examples, and further includes estimating the exhaust pressure based on periodic waveform outputs of a fuel controller during closed loop fuel control, where the periodic waveform outputs of the fuel controller are generated based on the periodic waveform outputs from the AFR sensor and not from pressure compensated outputs of the AFR sensor. A fourth example of the method optionally includes one or more of the first through third examples, and further includes wherein the outputs of the AFR sensor include voltages representing a partial pressure of oxygen in exhaust gasses sampled by the AFR sensor, and where the outputs of the AFR sensor are direct outputs of the AFR sensor and are not modified or adjusted by a control circuit or module. A fifth example of the method optionally includes one or more of the first through fourth examples, and further includes wherein the estimated exhaust pressure monotonically increases for increases in one or more of the standard deviation and frequency of cycles of the periodic waveform outputs.

As yet another embodiment, an engine system comprises: an exhaust oxygen sensor; one or more fuel injectors; and a controller with computer readable instructions stored in non-transitory memory for: determining a commanded amount of fuel to be injected by the one or more fuel injectors based on outputs from the exhaust oxygen sensor; adjusting the one or more fuel injectors to inject the commanded amount of fuel; and estimating an exhaust pressure based on one or more of the outputs from the exhaust oxygen sensor and changes in the commanded amount of fuel over a duration. In a first example of the engine system, the engine system further comprises an oxygen sensor monitoring module in electrical communication with the oxygen sensor and the controller, where the module includes instructions stored in non-transitory memory for adjusting the outputs of the oxygen sensor in response to fluctuations in exhaust pressure, and where the commanded amount of fuel to be injected is determined based on the adjusted outputs of the oxygen sensor generated by the module. A second example of the engine system optionally includes the first example and further includes wherein the controller further includes instructions for estimating the exhaust pressure based only on the outputs of the oxygen sensor and not based on the adjusted outputs of the oxygen sensor generated by the oxygen sensor monitoring module.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

monitoring a periodic waveform output, for multiple cycles, of a fuel controller during closed loop fuel control;

estimating an exhaust pressure based on a waveform characteristic, including one or more of a frequency, standard deviation, and amplitude, of the periodic waveform output while maintaining a desired air/fuel ratio of an engine at stoichiometry; and adjusting at least one engine operating parameter based on the estimated exhaust pressure.

2. The method of claim 1, wherein the periodic waveform output of the fuel controller includes a commanded fuel injection amount, and where the periodic waveform output is generated by the controller based on feedback from an exhaust oxygen sensor and wherein the periodic waveform output of the fuel controller oscillates back and forth between richer and leaner values of the desired air/fuel ratio set at stoichiometry.

3. The method of claim 2, wherein the feedback from the exhaust oxygen sensor is directly received by the fuel controller from the exhaust oxygen sensor and comprises raw output from the exhaust oxygen sensor that has not been adjusted by a control module for pressure.

4. The method of claim 1, wherein the estimating the exhaust pressure based on the periodic waveform output comprises estimating the exhaust pressure based on a frequency of the periodic waveform output, where the frequency is a number of cycles of the periodic waveform output per unit time.

5. The method of claim 4, wherein the estimated exhaust pressure monotonically increases for increases in the frequency of the periodic waveform output.

6. The method of claim 1, wherein the estimating the exhaust pressure based on the periodic waveform output comprises estimating the exhaust pressure based on a magnitude of a change in the periodic waveform output at a switchpoint, and where the estimated exhaust pressure monotonically increases for increases in the magnitude of the change in the periodic waveform output at the switchpoint.

7. The method of claim 1, wherein the estimating the exhaust pressure based on the periodic waveform output comprises estimating the exhaust pressure based on a difference between a minimum value and a maximum value of a single cycle of the periodic waveform output, and where the estimated exhaust pressure monotonically increases for increases in the difference between the minimum and maximum values.

8. The method of claim 1, wherein the adjusting the at least one engine operating parameter comprises opening a wastegate valve in response to the exhaust pressure increasing above a threshold.

9. The method of claim 1, wherein the adjusting the at least one engine operating parameter comprises closing an intake throttle in response to the exhaust pressure increasing above a threshold.

10. The method of claim 1, wherein the adjusting the at least one engine operating parameter comprises regenerating a particulate filter in response to the exhaust pressure increasing above a threshold.

11. The method of claim 1, wherein the estimating the exhaust pressure is based on the periodic waveform output of the fuel controller during at least a threshold duration where an intake mass airflow remains within a threshold range.

12. A method for an engine comprising:

monitoring a periodic waveform output from an exhaust air/fuel ratio (AFR) sensor during closed loop fuel control while maintaining a desired AFR of the engine at stoichiometry;

estimating an exhaust pressure based on one or more of a standard deviation and an average frequency of multiple cycles of the periodic waveform output; and adjusting at least one engine operating parameter based on the estimated exhaust pressure.

13. The method of claim 12, further comprising freezing the estimated exhaust pressure during open loop fuel control and not updating the estimated exhaust pressure based on one or more of the standard deviation and the average frequency of multiple cycles of the periodic waveform output.

14. The method of claim 12, further comprising;

monitoring outputs from the AFR sensor during open loop fuel control when an intake mass airflow is substantially constant; and estimating the exhaust pressure during the open loop fuel control when the intake mass airflow is substantially constant based on changes in an amount of oxygen measured by the AFR sensor, where the exhaust pressure increases monotonically for increases in the amount of oxygen measured by the AFR sensor.

15. The method of claim 12, further comprising estimating the exhaust pressure based on periodic waveform outputs of a fuel controller during closed loop fuel control, where the periodic waveform outputs of the fuel controller are generated based on the periodic waveform output from the AFR sensor and not from pressure compensated outputs of the AFR sensor.

16. The method of claim 12, wherein the periodic waveform output from the AFR sensor includes voltages representing a partial pressure of oxygen in exhaust gasses sampled by the AFR sensor, and where the periodic waveform output from the AFR sensor is a direct output of the AFR sensor and is not modified or adjusted by a control circuit or module and wherein the periodic waveform output from the AFR sensor includes a periodic waveform signal resulting from continuous oscillation between leaner than stoichiometry and richer than stoichiometry fuel injection commands.

17. The method of claim 12, wherein the estimated exhaust pressure monotonically increases for increases in one or more of the standard deviation and the average frequency of multiple cycles of the periodic waveform output.

18. An engine system comprising:

an exhaust oxygen sensor;

one or more fuel injectors; and a controller with computer readable instructions stored in non-transitory memory for:

determining a commanded amount of fuel to be injected by the one or more fuel injectors to maintain a desired air-fuel ratio of the engine system at stoichiometry based on multiple cycles of a periodic waveform output from the exhaust oxygen sensor, the periodic waveform output oscillating back and forth across a stoichiometric setpoint over time;

adjusting the one or more fuel injectors to inject the commanded amount of fuel; and while maintaining the desired air-fuel ratio at stoichiometry, estimating an exhaust pressure based on one or more of the periodic waveform output from the exhaust oxygen sensor and changes in the commanded amount of fuel over a duration, where the commanded amount of fuel is a periodic waveform and changes in the commanded amount of fuel over the duration are determined based on a waveform characteristic of the periodic waveform.

19. The system of claim 18, further comprising an oxygen sensor monitoring module in electrical communication with the exhaust oxygen sensor and the controller, where the module includes instructions stored in non-transitory memory for adjusting the periodic waveform output from the exhaust oxygen sensor in response to fluctuations in exhaust pressure, and where the commanded amount of fuel to be injected is determined based on the adjusted periodic waveform output from the exhaust oxygen sensor generated by the module and wherein estimating the exhaust pressure based on one or more of the periodic waveform output from the exhaust oxygen sensor and changes in the commanded amount of fuel includes estimating the exhaust pressure based on the waveform characteristic including one or more of an amplitude, frequency, and wavelength of one or more of the periodic waveform output from the exhaust oxygen sensor and the periodic waveform of the commanded amount of fuel.

20. The system of claim 19, wherein the controller further includes instructions for estimating the exhaust pressure based only on the periodic waveform output from the exhaust oxygen sensor and not based on the adjusted periodic waveform output from the exhaust oxygen sensor generated by the oxygen sensor monitoring module.

* * * * *